US009555459B2

(12) United States Patent
Monro et al.

(10) Patent No.: US 9,555,459 B2
(45) **Date of Patent: *Jan. 31, 2017**

(54) CAN MANUFACTURE

(71) Applicant: CROWN Packaging Technology, Inc., Alsip, IL (US)

(72) Inventors: Stuart Monro, Brighthampton (GB); Alain Presset, Chilton (GB); Jonathan Riley, Forest Hill, MD (US); Keith Vincent, Swindon (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/511,938

(22) Filed: Oct. 10, 2014

(65) Prior Publication Data

US 2015/0047407 A1 Feb. 19, 2015

Related U.S. Application Data

(63) Continuation of application No. 13/452,556, filed on Apr. 20, 2012, now abandoned, which is a (Continued)

(30) Foreign Application Priority Data

Apr. 12, 2010 (EP) ..... 10159582

(51) Int. Cl.
*B21D 22/24* (2006.01)
*B21D 22/28* (2006.01)
(Continued)

(52) U.S. Cl.
CPC ..... *B21D 25/04* (2013.01); *B21D 22/20* (2013.01); *B21D 22/22* (2013.01); *B21D 25/00* (2013.01);
(Continued)

(58) Field of Classification Search
CPC ..... B21D 22/20; B21D 22/22; B21D 22/24; B21D 22/28; B21D 22/30
See application file for complete search history.

(56) References Cited

U.S. PATENT DOCUMENTS 2,423,708 A 7/1947 Keogh et al.
2,602,411 A 7/1952 Schnell
(Continued)

FOREIGN PATENT DOCUMENTS

BE 784904 10/1972
CN 2042821 U 8/1989
(Continued)

OTHER PUBLICATIONS

English Translation of Japanese Patent Application No. 2013-504247: Official Action dated Sep. 9, 2015, 3 pages.
(Continued)

*Primary Examiner* — Teresa M Ekiert
(74) *Attorney, Agent, or Firm* — Baker & Hostetler LLP

(57) ABSTRACT

A method and apparatus are disclosed which are suitable for use in the manufacture of two-piece metal containers. In particular, a way of making cups from metal sheet is disclosed using a combination of stretching and drawing operations. The resulting cups have the advantage of having a base thickness that is thinner relative to the ingoing gauge of the metal sheet.

12 Claims, 22 Drawing Sheets

Related U.S. Application Data continuation of application No. PCT/EP2011/055741, filed on Apr. 12, 2011.

(51) Int. Cl.

| | |
|---|---|
| ***B21D 25/04*** | (2006.01) |
| ***B21D 22/20*** | (2006.01) |
| ***B21D 22/22*** | (2006.01) |
| ***B21D 25/00*** | (2006.01) |
| ***B21D 51/26*** | (2006.01) |
| ***B65D 8/00*** | (2006.01) |
| ***B21D 51/10*** | (2006.01) |

(52) U.S. Cl.

CPC ..... *B21D 51/10* (2013.01); *B21D 51/26* (2013.01); *B65D 15/22* (2013.01)

(56) References Cited

U.S. PATENT DOCUMENTS

| | | | |
|---|---|---|---|
| 3,367,533 | A | 2/1968 | Baker |
| 3,561,638 | A | 2/1971 | Morjan |
| 3,572,271 | A | 3/1971 | Fraze |
| 3,593,552 | A | 7/1971 | Fraze |
| 3,738,528 | A | 6/1973 | Kagami |
| 3,760,751 | A | 9/1973 | Dunn et al. |
| 3,820,368 | A | 6/1974 | Fakuzuka et al. |
| 3,855,862 | A | 12/1974 | Moller |
| 3,904,069 | A | 9/1975 | Toukmanian |
| 3,979,009 | A | 9/1976 | Walker |
| 3,998,174 | A | 12/1976 | Saunders |
| 4,020,670 | A | 5/1977 | Bulso, Jr. et al. |
| 4,095,544 | A | 6/1978 | Peters |
| 4,147,271 | A | 4/1979 | Yamaguchi |
| 4,214,471 | A | 7/1980 | Bulso, Jr. et al. |
| 4,248,076 | A | 2/1981 | Bulso, Jr. et al. |
| 4,341,321 | A | 7/1982 | Gombas |
| 4,343,173 | A | 8/1982 | Bulso, Jr. et al. |
| 4,372,143 | A | 2/1983 | Elert et al. |
| 4,416,140 | A | 11/1983 | Bulso, Jr. et al. |
| 4,416,389 | A | 11/1983 | Wilkinson et al. |
| 4,454,743 | A | 6/1984 | Bulso, Jr. et al. |
| 4,483,172 | A | 11/1984 | Bulso, Jr. et al. |
| 4,535,618 | A | 8/1985 | Bulso, Jr. et al. |
| 4,541,265 | A | 9/1985 | Dye et al. |
| 4,685,322 | A | 8/1987 | Clowes |
| 4,696,177 | A | 9/1987 | Bulso, Jr. et al. |
| 4,732,031 | A | 3/1988 | Bulso, Jr. et al. |
| 4,800,743 | A | 1/1989 | Bulso, Jr. et al. |
| 4,826,382 | A | 5/1989 | Bulso, Jr. et al. |
| 5,024,077 | A | 6/1991 | Bulso, Jr. et al. |
| 5,058,408 | A | 10/1991 | Leftault et al. |
| 5,083,449 | A | 1/1992 | Kobayashi et al. |
| 5,102,002 | A | 4/1992 | Whitley |
| 5,111,679 | A | 5/1992 | Kobayashi et al. |
| 5,218,849 | A | 6/1993 | Sieger et al. |
| 5,394,727 | A | 3/1995 | Diekhoff et al. |
| 5,487,295 | A | 1/1996 | Diekhoff et al. |
| 5,522,248 | A | 6/1996 | Diekhoff et al. |
| 5,605,069 | A | 2/1997 | Jentzsch |
| 5,630,337 | A | 5/1997 | Werth |
| 5,689,992 | A | 11/1997 | Saunders et al. |
| 5,700,529 | A | 12/1997 | Kobayashi et al. |
| 5,749,258 | A | 5/1998 | Werth |
| 5,881,593 | A | 3/1999 | Bulso, Jr. et al. |
| 5,970,767 | A | 10/1999 | Hartman et al. |
| 6,063,214 | A | 5/2000 | Fujinaga et al. |
| 6,286,705 | B1 | 9/2001 | Mihalov et al. |
| 6,305,210 | B1 | 10/2001 | Saunders et al. |
| 6,505,492 | B2 | 1/2003 | Jroski |
| 6,701,603 | B2 | 3/2004 | Matsuura et al. |
| 7,124,613 | B1 | 10/2006 | McClung |
| 7,185,525 | B2 | 3/2007 | Werth et al. |
| 7,624,611 | B2 | 12/2009 | Saitou |
| 8,313,003 | B2 | 11/2012 | Riley |
| 8,490,455 | B2 | 7/2013 | Kubo |
| 2002/0074867 | A1 | 6/2002 | Matsuura et al. |
| 2002/0148272 | A1 | 10/2002 | Jroski |
| 2006/0159989 | A1 | 7/2006 | Bouffard |
| 2007/0125147 | A1 | 6/2007 | Hodjat |
| 2009/0026214 | A1 | 1/2009 | Yuan et al. |
| 2011/0089182 | A1 | 4/2011 | McClung et al. |
| 2011/0186465 | A1 | 8/2011 | Riley |
| 2012/0255656 | A1 | 10/2012 | Nakagawa et al. |

FOREIGN PATENT DOCUMENTS

| | | | |
|---|---|---|---|
| CN | 1044925 | A | 8/1990 |
| CN | 101232993 | A | 7/2008 |
| DE | 2625170 | | 12/1977 |
| DE | 10 2007050580 | | 4/2009 |
| DE | 10 2007050581 | | 4/2009 |
| DE | 10 2008047848 | | 4/2010 |
| EP | 0425704 | | 5/1991 |
| EP | 0542552 | | 5/1993 |
| GB | 1438207 | | 6/1976 |
| GB | 2103134 | | 2/1983 |
| GB | 2286364 | | 8/1995 |
| GB | 2316029 | A | 2/1998 |
| JP | 53-014159 | | 2/1978 |
| JP | 54-61069 | A | 5/1979 |
| JP | 01178325 | | 7/1989 |
| JP | 4147730 | A | 5/1992 |
| JP | 7232230 | A | 9/1995 |
| JP | 7300124 | A | 11/1995 |
| JP | 8033933 | A | 2/1996 |
| JP | 871674 | A | 3/1996 |
| JP | 08-267154 | A | 10/1996 |
| JP | 11226684 | A | 8/1999 |
| JP | 3046217 | A | 5/2000 |
| JP | 2002-307117 | A | 10/2002 |
| WO | WO 94/16842 | A1 | 8/1994 |
| WO | WO 02/45882 | | 6/2002 |
| WO | WO 2011/095613 | A1 | 8/2011 |

OTHER PUBLICATIONS

International Patent Application No. PCT/EP2011/051695: International Search Report dated Apr. 7, 2011, 6 pages.

English Translation of Chinese Patent Application No. 201180016908.6: First Office Action dated May 6, 2014, 3 pages.

CAN MANUFACTURE

CROSS-REFERENCED TO RELATED APPLICATIONS

This application is a continuation of U.S. application Ser. No. 13/452,556, filed Apr. 20, 2012, which is a continuation of International Application No. PCT/EP2011/055741, filed Apr. 12, 2011, which claims priority to European Patent Application No. EP 10159582.5, filed Apr. 12, 2010, the contents of each of which are incorporated herein by reference in their entireties.

TECHNICAL FIELD

This invention relates to the production of metal cups and in particular (but without limitation) to metal cups suitable for the production of "two-piece" metal containers.

BACKGROUND

U.S. Pat. No. 4,095,544 (NATIONAL STEEL CORPORATION) Jun. 20, 1978 details conventional Draw & Wall Ironing (DWI) and Draw & Re-Draw (DRD) processes for manufacturing cup-sections for use in making two-piece metal containers. [Note that in the United States of America, DWI is instead commonly referred to as D&I.] The term "two-piece" refers to i) the cup-section and ii) the closure that would be subsequently fastened to the open end of the cup-section to form the container.

In a DWI (D&I) process (as illustrated in FIGS. 6 to 10 of U.S. Pat. No. 4,095,544), a flat (typically) circular blank stamped out from a roll of metal sheet is drawn through a drawing die, under the action of a punch, to form a shallow first stage cup. This initial drawing stage does not result in any intentional thinning of the blank. Thereafter, the cup, which is typically mounted on the end face of a close fitting punch or ram, is pushed through one or more annular wall-ironing dies for the purpose of effecting a reduction in thickness of the sidewall of the cup, thereby resulting in an elongation in the sidewall of the cup. By itself, the ironing process will not result in any change in the nominal diameter of the first stage cup.

FIG. 1 shows the distribution of metal in a container body resulting from a conventional DWI (D&I) process. FIG. 1 is illustrative only, and is not intended to be precisely to scale. Three regions are indicated in FIG. 1:

- Region 1 represents the un-ironed material of the base. This remains approximately the same thickness as the ingoing gauge of the blank, i.e. it is not affected by the separate manufacturing operations of a conventional DWI process.
- Region 2 represents the ironed mid-section of the sidewall. Its thickness (and thereby the amount of ironing required) is determined by the performance required for the container body.
- Region 3 represents the ironed top-section of the sidewall. Typically in can making, this ironed top-section is around 50-75% of the thickness of the ingoing gauge.

In a DRD process (as illustrated in FIGS. 1 to 5 of U.S. Pat. No. 4,095,544), the same drawing technique is used to form the first stage cup. However, rather than employing an ironing process, the first stage cup is then subjected to one or more re-drawing operations which act to progressively reduce the diameter of the cup and thereby elongate the sidewall of the cup. By themselves, most conventional re-drawing operations are not intended to result in any change in thickness of the cup material. However, taking the example of container bodies manufactured from a typical DRD process, in practice there is typically some thickening at the top of the finished container body (of the order of 10% or more). This thickening is a natural effect of the re-drawing process and is explained by the compressive effect on the material when re-drawing from a cup of large diameter to one of smaller diameter.

Note that there are alternative known DRD processes which achieve a thickness reduction in the sidewall of the cup through use of small or compound radii draw dies to thin the sidewall by stretching in the draw and re-draw stages.

Alternatively, a combination of ironing and re-drawing may be used on the first stage cup, which thereby reduces both the cup's diameter and sidewall thickness. For example, in the field of the manufacture of two-piece metal containers (cans), the container body is typically made by drawing a blank into a first stage cup and subjecting the cup to a number of re-drawing operations until arriving at a container body of the desired nominal diameter, then followed by ironing the sidewall to provide the desired sidewall thickness and height.

However, DWI (D&I) and DRD processes employed on a large commercial scale have a serious limitation in that they do not act to reduce the thickness (and therefore weight) of material in the base of the cup. In particular, drawing does not result in reduction in thickness of the object being drawn, and ironing only acts on the sidewalls of the cup. Essentially, for known DWI (D&I) and DRD processes for the manufacture of cups for two-piece containers, the thickness of the base remains broadly unchanged from that of the ingoing gauge of the blank. This can result in the base being far thicker than required for performance purposes.

The metal packaging industry is fiercely competitive, with weight reduction being a primary objective because it reduces transportation and raw material costs. By way of example, around 65% of the costs of manufacturing a typical two-piece metal food container derive from raw material costs.

There is therefore a need for improved light-weighting of metal cup-sections in a cost-effective manner. Note that in this document, the terms "cup-section" and "cup" are used interchangeably.

SUMMARY

Accordingly, in a first aspect of the invention there is provided a method for manufacture of a metal cup, the method comprising the following operations:

i. a stretching operation performed on a metal sheet, the operation comprising clamping an annular region on the sheet to define an enclosed portion, and deforming and stretching all or part of the enclosed portion to thereby increase the surface area and reduce the thickness of the enclosed portion, the annular clamping adapted to restrict or prevent metal flow from the clamped region into the enclosed portion during this stretching operation;

ii. a drawing operation for drawing the metal sheet into a cup having a sidewall and an integral base, wherein the base comprises material from the stretched and thinned enclosed portion, the drawing operation adapted to pull and transfer outwardly material of the stretched and thinned enclosed portion.

The method of the invention has the advantage (over known processes) of achieving manufacture of a cup having a base which is thinner than the ingoing gauge of the metal sheet (i.e. prior to the stretching operation), without requiring loss or waste of metal. When applied to the manufacture of two-piece containers, the invention enables cost savings to be made of the order of several dollars per 1,000 containers relative to existing manufacturing techniques.

The stretching operation is essential to achieve manufacture of a cup having a base that is thinner than the ingoing gauge of the metal sheet. The increased surface area of the enclosed portion resulting from the stretching operation provides "excess material". This "excess material" is pulled and transferred outwardly during the subsequent drawing operation.

Most preferably, the drawing operation is adapted such that material of the stretched and thinned enclosed portion is pulled and transferred into the sidewall, rather than remaining in the base. This has the benefit of increasing both the height of the sidewall and the enclosed volume of the resulting cup. As stated in the description of the Background Art, the sidewall thickness is critical in affecting the performance characteristics of a cup used for a container (can) body. This aspect of the invention has the advantage of enabling transfer of material into the performance critical part of the cup (i.e. the sidewall), whilst also minimizing the thickness and weight of the cup's base.

To ensure that the enclosed portion is stretched and thinned during the stretching operation, the metal sheet is clamped sufficiently to restrict or prevent metal flow from the clamped region into the enclosed portion during the stretching operation. If the clamping loads are insufficient, material from the clamped region (or from outside of the clamped region) would merely be drawn into the enclosed portion, rather than the enclosed portion undergoing any thinning. It has been found that stretching and thinning can still occur when permitting a limited amount of flow of material from the clamped region (or from outside of the clamped region) into the enclosed portion, i.e. when metal flow is restricted rather than completely prevented. The subsequent transfer of the stretched and thinned material outwardly and into the sidewall during the drawing operation is better illustrated in the embodiments of the invention shown in the attached drawings (see especially FIGS. 12*b*, 13*c* and 13*d*).

The method of the invention is particularly suitable for use in the manufacture of metal containers, with the final resulting cup being used for the container body. The final resulting cup may be formed into a closed container by the fastening of a closure to the open end of the cup. For example, a metal can end may be seamed to the open end of the final resulting cup (see FIG. 16).

The method of the invention is suitable for use on cups that are both round and non-round in plan. However, it works best on round cups.

One way of minimising the amount of material in the base of cup-sections produced using conventional DWI and DRD processes would be to use thinner gauge starting stock. However, tinplate cost per tonne increases as the gauge decreases. This increase is explained by additional costs of rolling, cleaning and tinning the thinner steel. When also taking account of material usage during manufacture of a two-piece container, the variation in net overall cost to manufacture the container versus ingoing gauge of material looks like the graph shown in FIG. 2. This graph demonstrates that from a cost perspective, going for the thinnest gauge material does not necessarily reduce costs. In essence, there is a cheapest gauge of material for any container of a given sidewall thickness. The graph also shows the effect of reducing the thickness of the top and mid-wall sections of the container in driving down the cost curve. FIG. 3 shows the same graph based upon actual data for UK-supplied tinplate of the type commonly used in can-making. For the material illustrated in FIG. 3, 0.285 mm represents the optimum thickness on cost grounds, with the use of thinner gauge material increasing net overall costs for can production. The graph of FIG. 3 shows the percentage increase in overall cost per 1,000 cans when deviating from the 0.285 mm optimum ingoing gauge thickness.

The final resulting cup of the invention has the benefits of a thinner (and therefore lighter) base. Also, dependent on the drawing operation employed, material transferred outwardly from the stretched and thinned enclosed portion is able to contribute to maximising the sidewall height. In this way, the invention provides an increased enclosed cup volume for a given amount of metal—relative to known methods of manufacturing cup-sections for two-piece containers. Additionally, the cost of manufacturing each container (on a cost per tonne or unit volume basis) is reduced because the invention allows thicker (and therefore cheaper) ingoing gauge material to be used for the metal sheet used to form the cup.

By clamping an "annular region" is meant that the metal sheet is clamped either continuously or at spaced intervals in an annular manner.

Conveniently, a clamping means is employed comprising a clamping element in the form of an annular ring having a highly polished clamping face pressing against the annular region of the metal sheet. However, it has been found that reduced clamping loads are possible to obtain the same stretching effect, when using a clamping element with a clamping face that is textured. The texturing has the effect of roughening the surface of the clamping face and thereby increasing the gripping effect of the clamping element on the annular region of the metal sheet for a given clamping load. The textured clamping element is therefore better able to restrict or prevent metal flow from the clamped region during the stretching operation. By way of example, the surface roughening of the clamping face has been induced by subjecting an initially smooth clamping face to electric discharge machining (EDM), which erodes the surface of the clamping face to define a pitted, roughened surface.

In one form, the clamping may conveniently be achieved by clamping opposing surfaces of the metal sheet between corresponding opposing first and second clamping elements, each of the first and second clamping elements having a clamping face free of geometric discontinuities. For example, the first and second clamping elements may conveniently have wholly planar smooth clamping faces. However, it has been found that introducing geometric discontinuities into the opposing clamping faces of the first and second clamping elements provides improved clamping with reduced unwanted slippage or drawing of material during the stretching operation. This has the benefits of reducing the clamping loads required during the stretching operation to achieve a given amount of stretching. By "geometric discontinuities" is meant structural features in the respective clamping faces of the first and second clamping elements which, when the clamping elements are used to clamp opposing surfaces of the metal sheet, act on the metal sheet to disrupt the flow of metal between the clamping elements as the stretching load is applied.

In one form, the geometric discontinuities may be provided by forming the face of the first clamping element with one or more beads, ridges or steps which, in use, urge metal of the clamped annular region within corresponding one or more relief features provided in the face of the second clamping element. The relief features are conveniently provided as cut-outs or recesses in the clamping face, being shaped and sized to accommodate the corresponding one or more beads, ridges or steps. In use, the first and second clamping elements would clamp the opposing surfaces of the metal sheet, with the effect of the one or more beads, ridges or steps and corresponding one or more relief features being to disrupt the flow of the metal sheet between the first and second clamping elements as the stretching load is applied. This disruption of the flow of metal is what enables the improved clamping effect for a given clamping load over merely clamping the metal sheet between first and second clamping elements having wholly smooth clamping faces. It was found to be beneficial to have sufficient clearance between the one or more beads/ridges/steps and corresponding one or more relief features to avoid pinching or coining of the metal, because this helps to minimise the formation of weak points that would be vulnerable to tearing during the subsequent drawing operation (or any subsequent ironing operation). Significant reductions in clamping loads required for a given amount of stretching were seen when the first and second clamping elements were adapted such that, in use, the one or more beads/ridges/steps urged metal of the clamped annular region so as to be wholly enclosed by and within the corresponding relief feature(s). An example of this clamping configuration is illustrated in the description of the embodiments of the invention (see the embodiment illustrated in FIG. 7*a*).

Although the above paragraph refers to the one or more beads/ridges/steps being located in the face of the first clamping element and the corresponding one or more relief features being located in the face of the second clamping element, the invention is not limited to this. In particular, the one or more beads/ridges/steps may alternatively be located in the face of the second clamping element and corresponding one or more relief features located in the face of the first clamping element. As a further alternative, each of the faces of the first and second clamping elements may comprise a mixture of beads/ridges/steps and corresponding relief features. However, it is believed that providing a single bead/ridge/step and corresponding single relief feature in the clamping face of the respective clamping elements is able to achieve significant reductions in clamping load required for a given amount of stretching (see the embodiments illustrated in FIGS. 6*a* and 7*a*). As indicated in the above paragraph, significant reductions in clamping load were seen when the first and second clamping elements were adapted such that, in use, the bead/ridge/step provided in the clamping face of the first or second clamping element urges metal of the clamped annular region so as to be wholly enclosed by and within the corresponding relief feature in the clamping face of the second or first clamping element (see Table 1 in the description of the embodiments of the invention).

Note that the first and second clamping elements need not be continuous; for example, segmented tooling may be used for each or one of the first and second clamping elements. Expressed another way, each or one of the clamping elements may itself comprise two or more discrete clamping portions which each, in use, act upon a discrete area of the metal sheet.

Preferably, the stretching operation comprises providing a "stretch" punch and moving either or both of the "stretch" punch and the metal sheet toward each other so that the "stretch" punch deforms and stretches all or part of the enclosed portion.

In its simplest form, the "stretch" punch is a single punch having an end face which, when urged into contact with the metal sheet, both deforms and stretches all or part of the enclosed portion. Preferably, the end face of the "stretch" punch is provided with a non-planar profile, either or both of the "stretch" punch and the metal sheet moved towards each other so that the "stretch" punch deforms and stretches all or part of the enclosed portion into a corresponding non-planar profile. Conveniently, the end face would be provided with a domed or part-spherical profile, which in use acts to stretch and deform all or part of the enclosed portion into a correspondingly domed or part-spherical profile. By way of example, FIG. 4 shows the variation in the thickness of a metal sheet section after a stretching operation performed on an enclosed portion of the sheet using a single "stretch" punch provided with a domed-profiled end face. The sheet had an ingoing gauge thickness of 0.0115 inches (0.29 mm), with the minimum thickness of the enclosed portion after the stretching operation being 0.0086 inches (0.22 mm), representing a 25% peak reduction in thickness relative to the ingoing gauge of the sheet. In the example shown, the degree of thinning resulting from the stretching operation was non-uniform across the diameter defined by the punch. Varying the profile of the end face of the punch has been found to affect the thickness profile of the enclosed portion and, in particular, the location of maximum thinning. By way of example, in vertical section the end face of the punch may have compound radii or be oval in profile. To enable different levels of thinning to be achieved across the enclosed portion, the "stretch" punch preferably comprises an end face having one or more relief features. For example, the end face may include one or more recesses or cut-outs (see FIG. 9).

As an alternative to having a single punch, the "stretch" punch may instead comprise a punch assembly, the assembly comprising a first group of one or more punches opposing one surface of the enclosed portion and a second group of one or more punches opposing the opposite surface of the enclosed portion, the stretching operation comprising moving either or both of the first and second groups towards each other to deform and stretch all or part of the enclosed portion. Such a punch assembly may, for example, allow the enclosed portion to be deformed into an undulating profile, which may allow the enclosed portion to be stretched in a more uniform manner than that shown in FIGS. 5*a* and 5*b* (see the example shown in FIG. 8).

As a further alternative to using either a single punch or a punch assembly, the stretching operation may instead be achieved by spinning. For example, the spinning may comprise use of a profiled tool that is rotatably and/or pivotally mounted, the tool and enclosed portion of the metal sheet being brought into contact with each other, with either or both of the profiled tool and metal sheet being rotated and/or pivoted relative to each other such that the profiled tool progressively profiles and stretches the enclosed portion.

The "metal sheet" used in the stretching operation may be of many forms. Conveniently, before commencing the stretching operation a blank is cut from a larger expanse of metal sheet, the blank being suitable for forming into the cup. In this case, for the purpose of the invention the blank would be the "metal sheet". Alternatively, the stretching operation would be performed on such a larger expanse of metal sheet, with a blank cut from the metal sheet after stretching. In this alternative case, for the purpose of the invention the larger expanse of metal sheet would be the "metal sheet".

Conveniently, the stretching operation is performed on a plurality of enclosed portions separated from each other and disposed across the area of the metal sheet (see for example, FIG. 10). Separate blanks would then be cut from the stretched metal sheet for subsequent drawing to form corresponding cups. To maximise productivity, two or more of the enclosed portions are stretched simultaneously. This simultaneous stretching may conveniently be enabled through use of a corresponding number of "stretch" punches spaced apart from each other and each having a domed end face, moving either or both of each "stretch" punch and the metal sheet toward each other so that each "stretch" punch deforms and stretches its corresponding enclosed portion. In this way, the process would result in the metal sheet appearing to have a number of separate stretched dimples. However, there is a trade-off between the productivity benefits of maximising the number of enclosed portions simultaneously stretched in a given expanse of metal sheet at one time, and the resulting high peak loads imposed on the tooling used. Where the metal sheet is to be formed with, say, seven or more enclosed portions, it is preferred that not all of the enclosed portions undergo stretching at once. Instead, it is preferred that any simultaneous stretching of the enclosed portions is staggered to reduce the peak loads seen by the tooling used; for example, conveniently the stretching would progress radially inwardly or outwardly (as shown in FIGS. 11*a* and 11*b*).

The drawing operation performed on the stretched cup may have just a single drawing stage, or instead comprise an initial drawing stage and one or more subsequent re-drawing stages. The single or initial drawing stage would form the cup profile, with any subsequent re-drawing stages effecting a staged reduction in cup diameter and increase in sidewall height. The drawing operation is conveniently performed by drawing the stretched metal sheet through one or a succession of draw dies, to pull and transfer outwardly material of the stretched and thinned enclosed portion, preferably into the sidewall. Whether the stretched and thinned material of the enclosed portion remains wholly within the base or is transferred into the sidewall, the effect is still to provide a cup having a base with a thickness less than the ingoing gauge of the metal sheet.

Taking the example of where the stretching operation has been performed using a punch having an end face with a domed profile to stretch and thin the enclosed portion into a correspondingly domed shape, the effect of the drawing operation (whether consisting of a single or multiple drawing stages) would be to lessen the height of the "dome" as material of the enclosed portion is progressively pulled and transferred outwardly. The drawing operation may be sufficient to essentially flatten the stretched and thinned domed enclosed portion; however, this is not a requirement of the invention. For example, in the case of cups intended for use as containers for carbonated beverages (or other pressurised products), such containers commonly have a base that is inwardly-domed for the purpose of resisting pressurisation from the product. Where the cup of the invention is intended for use as such a container, it may be preferable to retain some of the "dome" resulting from the stretching operation. This retention of the dome in the base of the cup may be assisted by the use of a plug, insert or equivalent means located adjacent the enclosed portion during the drawing operation, the plug or insert acting to limit any flattening of the dome during the drawing operation. Where the cup is also subjected to an ironing operation and it is desired to retain some of the "dome", it may be necessary to also use a plug, insert or equivalent means to avoid the back tension resulting from the ironing operation flattening the dome. Alternatively or in addition, it is likely that the cup would undergo a later reforming operation to provide the domed base of the cup with a desired final profile necessary to resist in-can pressure.

Apparatus of various forms may be used to perform the drawing operation. The stages of the drawing operation would typically involve first slidably clamping the metal sheet (or the later formed cup) at a location between a "draw" die and a "draw" punch, the "draw" punch adapted to move through the "draw" die to perform the drawing. The initial drawing stage to form the cup-shaped profile may conveniently be performed in a conventional cupping press. Any subsequent re-drawing stages on the cup may conveniently be performed using a bodymaker/press having one or a succession of re-draw dies. However, the drawing operation is not limited to use of a conventional draw punch/draw die arrangement. For example, the drawing operation may comprise blow-forming using compressed air/gases or liquids to draw the metal sheet against the draw die or a mould. In essence, the drawing operation (whether consisting of single or multiple stages) encompasses any means of applying a drawing force.

By "slidably clamping" is meant that the clamping load during drawing is selected so as to permit the metal sheet to slide, relative to whatever clamping means is used (e.g. a draw pad), in response to the deforming action of the draw die on the metal sheet. An intention of this slidable clamping is to prevent or restrict wrinkling of the material during drawing.

A second aspect of the invention relates to an apparatus for working the method of the invention. Some of the features of such an apparatus have already been described above. However, for completeness, the apparatus claims are briefly discussed below. The term "apparatus" encompasses not only a single plant item, but also includes a collection of discrete plant items that, collectively, are able to work the claimed method of the invention (e.g. similar to the assembly line of a car plant, with successive operations performed by different items of plant).

According to the second aspect of the invention, there is provided an apparatus for manufacture of a metal cup, the apparatus comprising:

a clamping means for clamping a metal sheet during a stretching operation, the clamping means adapted to clamp an annular region on the sheet to define an enclosed portion;

a stretch tool adapted to deform and stretch all or part of the enclosed portion in the stretching operation to thereby increase the surface area and reduce the thickness of the enclosed portion, the clamping means further adapted to restrict or prevent metal flow from the clamped region into the enclosed portion during this stretching operation; and means for drawing the metal sheet into a cup having a sidewall and an integral base, the base comprising material from the stretched and thinned enclosed portion, the drawing means adapted to pull and transfer outwardly material of the stretched and thinned enclosed portion in a drawing operation.

Ideally, to maximise the cup volume per unit weight of material (i.e. raw material utilisation), the drawing means is further adapted to pull and transfer material of the stretched and thinned enclosed portion into the sidewall.

The clamping means may comprise a clamping element in the form of a continuous annular sleeve; alternatively, it may be a collection of discrete clamping element portions distributed in an annular manner to act against the metal sheet.

The clamping means preferably comprises a first clamping element and a second clamping element, the first and second clamping elements adapted to clamp opposing surfaces of the metal sheet. The respective clamping faces may have the features discussed in the above paragraphs relating to the method of the invention, i.e. each clamping face being free of geometric discontinuities, or preferably each clamping face provided with geometric discontinuities to provide the benefit of a reduced clamping load for a given amount of stretch.

Preferably, the stretch tool comprises a "stretch" punch, the apparatus adapted to move either or both of the "stretch" punch and the metal sheet toward each other so that, in use, the "stretch" punch deforms and stretches all or part of the enclosed portion. As indicated in discussion of the method of the invention, the "stretch" punch may simply be a single punch having an end face which, in use, is urged against the enclosed portion of the metal sheet to perform the stretching operation. Trials have been performed using a single punch as the "stretch" punch, the end face of the single punch having a domed or generally part-spherical profile which, in use, stretches the enclosed portion into a correspondingly shaped domed or part-spherical profile. Alternatively, in vertical section the end face of the punch may have compound radii or be oval in profile. To enable different levels of thinning to be achieved across the enclosed portion, the "stretch" punch may preferably comprise an end face having one or more relief features. For example, the end face may include one or more recesses or cut-outs (see FIG. 9).

In an alternative embodiment, the "stretch" punch comprises a punch assembly, the assembly comprising a first group of one or more punches opposing one surface of the enclosed portion and a second group of one or more punches opposing the opposite surface of the enclosed portion, the first and second groups moveable towards each other to, in use, deform and stretch all or part of the enclosed portion.

As referred to in discussion of the method of the invention, the drawing operation is conveniently performed by drawing the cup through one or a succession of draw dies, to transfer material outwardly from the stretched and thinned enclosed portion, preferably into the sidewalk. The means for drawing preferably comprises a draw punch (or succession of punches) and corresponding draw die(s).

Furthermore, preferably the apparatus further comprises one or a succession of ironing dies to both reduce the thickness and increase the height of the sidewall in an ironing operation.

The method and apparatus of the invention are not limited to a particular metal. They are particularly suitable for use with any metals commonly used in DWI (D&I) and DRD processes. Also, there is no limitation on the end use of the cup that results from the method and apparatus of the invention. Without limitation, the cups may be used in the manufacture of any type of container, whether for food, beverage or anything else. However, the invention is particularly beneficial for use in the manufacture of containers for food, especially with regard to the cost savings that can be made relative to known manufacturing techniques.

Figure 1:
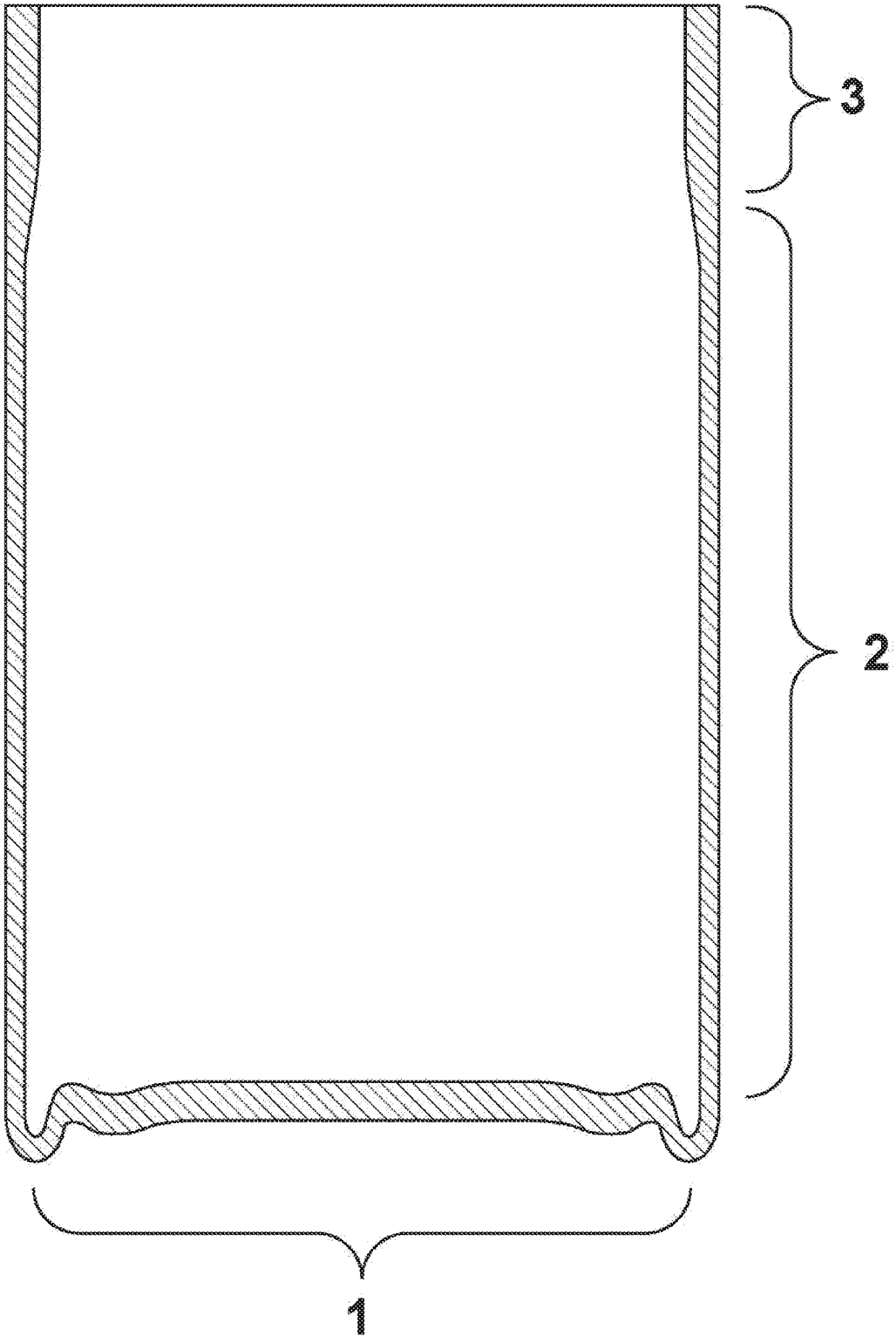
Figure 1 Prior Art
FIG. 1 is a side elevation view of a container body of the background art resulting from a conventional DWI process. It shows the distribution of material in the base and sidewall regions of the container body.
Figure 2:
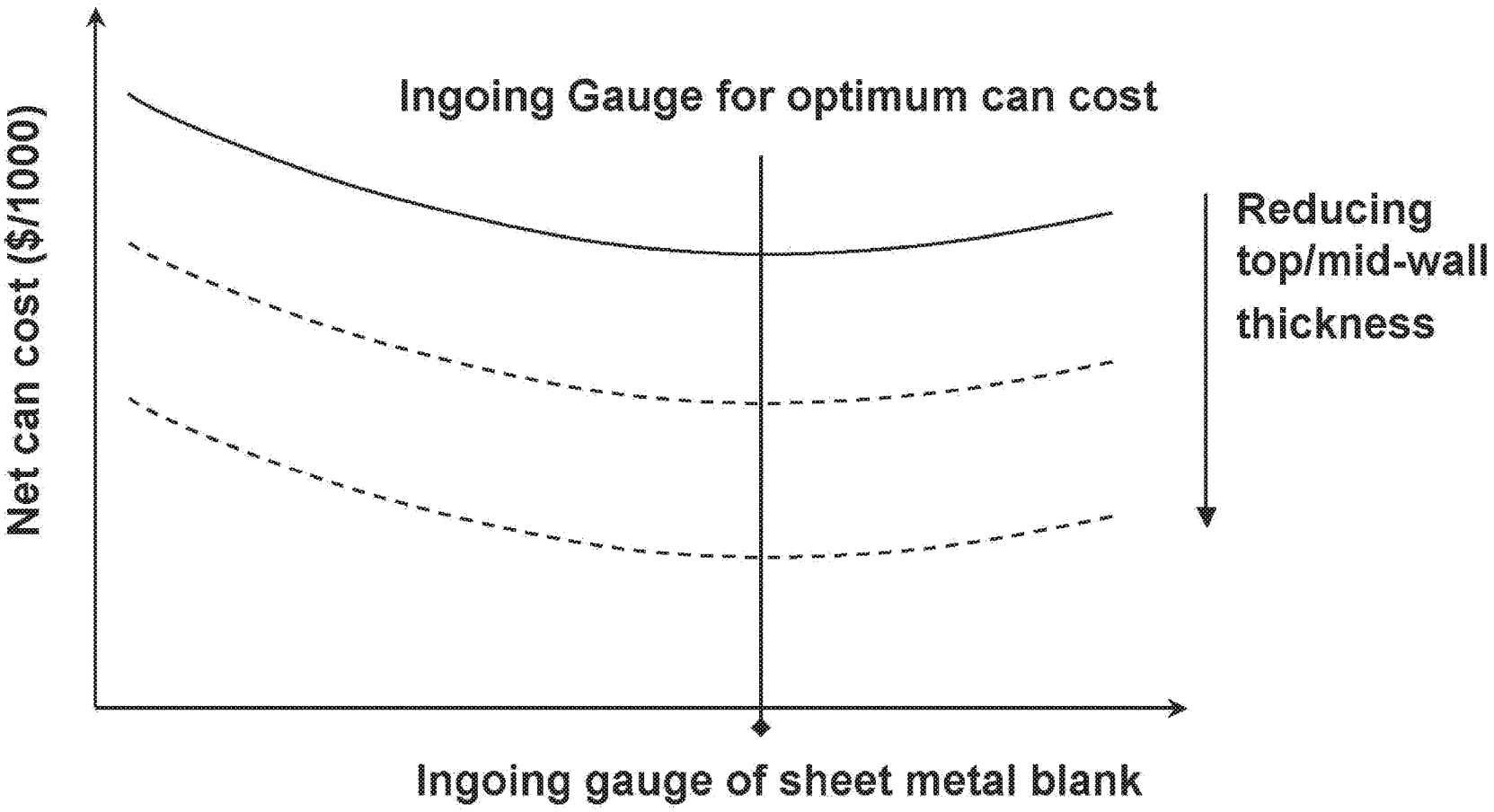
Figure 2 Prior Art
FIG. 2 is a graph showing in general terms how the net overall cost of manufacturing a typical two-piece metal container varies with the ingoing gauge of the sheet metal. The graph shows how reducing the thickness of the sidewall region (e.g. by ironing) has the effect of driving down the net overall cost.
Figure 3:
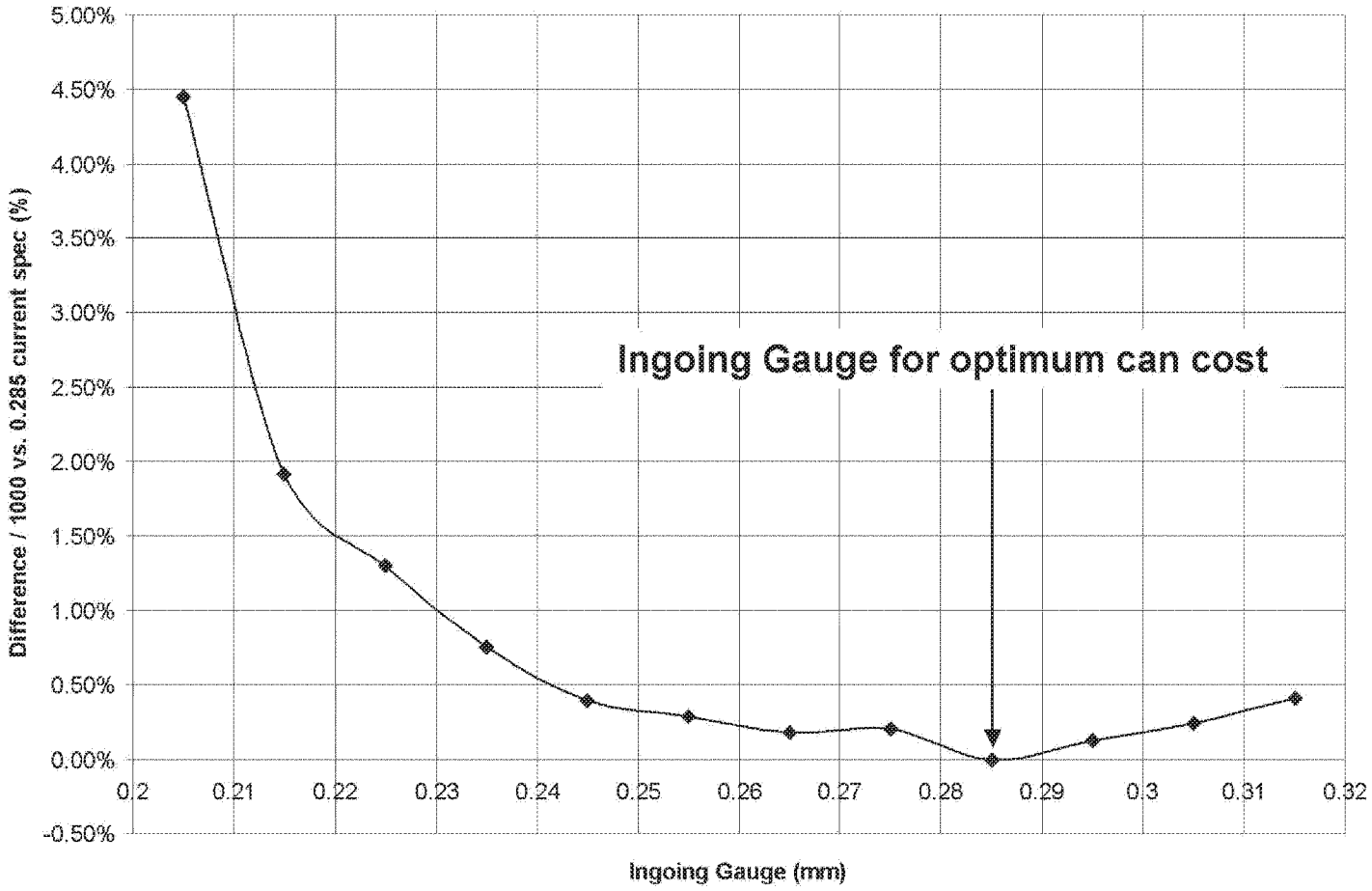
Figure 3 Prior Art
FIG. 3 is a graph corresponding to FIG. 2, but based on actual price data for UK-supplied tinplate.
Figure 4:
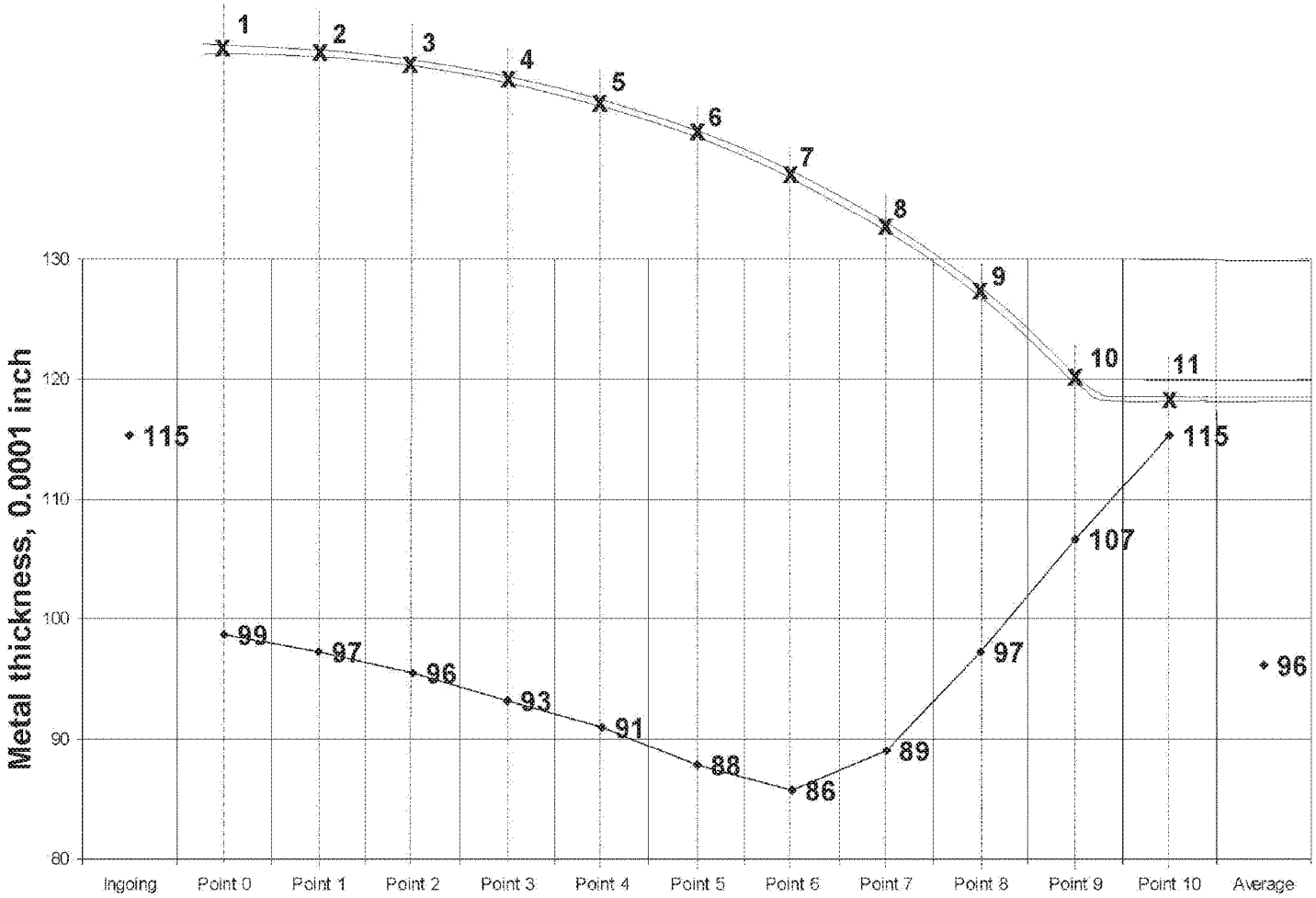

Embodiments of the invention are illustrated in the following drawings, with reference to the accompanying description:

FIG. 4 is a graphical representation of the variation in thickness of the "enclosed portion" of a metal sheet that has been subjected to a stretching operation using a "stretch" punch having a domed profiled end face.

Figure 5A:
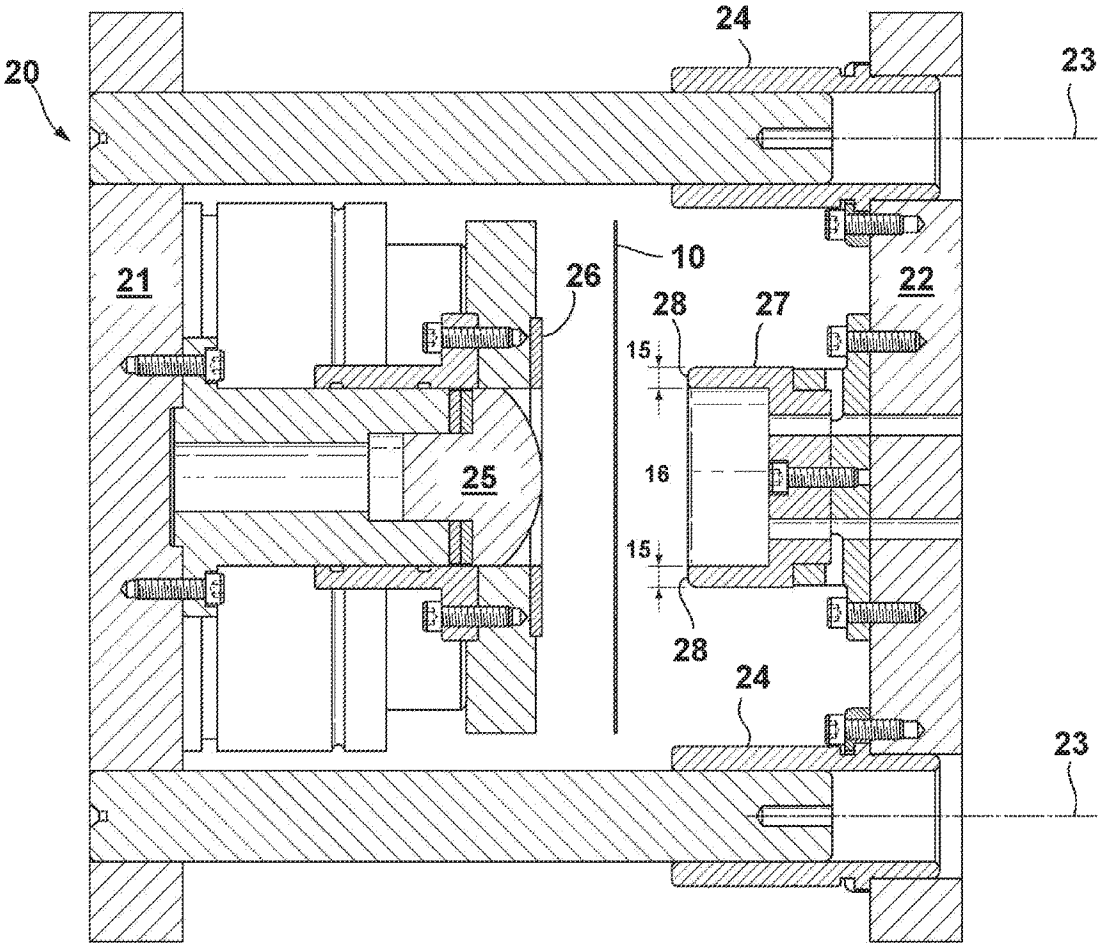

FIG. 5*a* is a side elevation view of a stretch rig used to perform the stretching operation of the invention. The figure shows the stretch rig before the stretching operation has commenced.

Figure 5B:
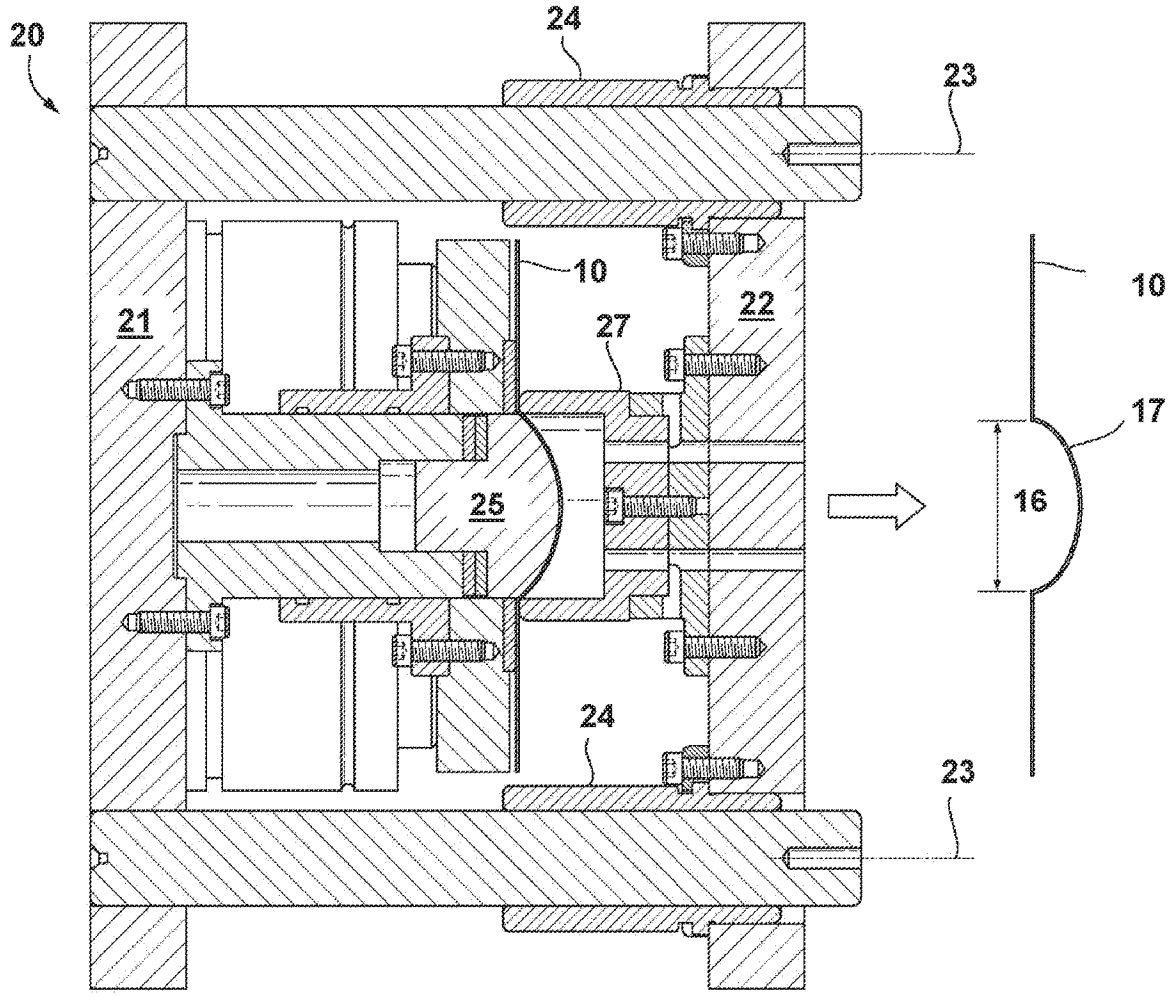

FIG. 5*b* shows the stretch rig of FIG. 5*a*, but on completion of the stretching operation.

Figure 6A:
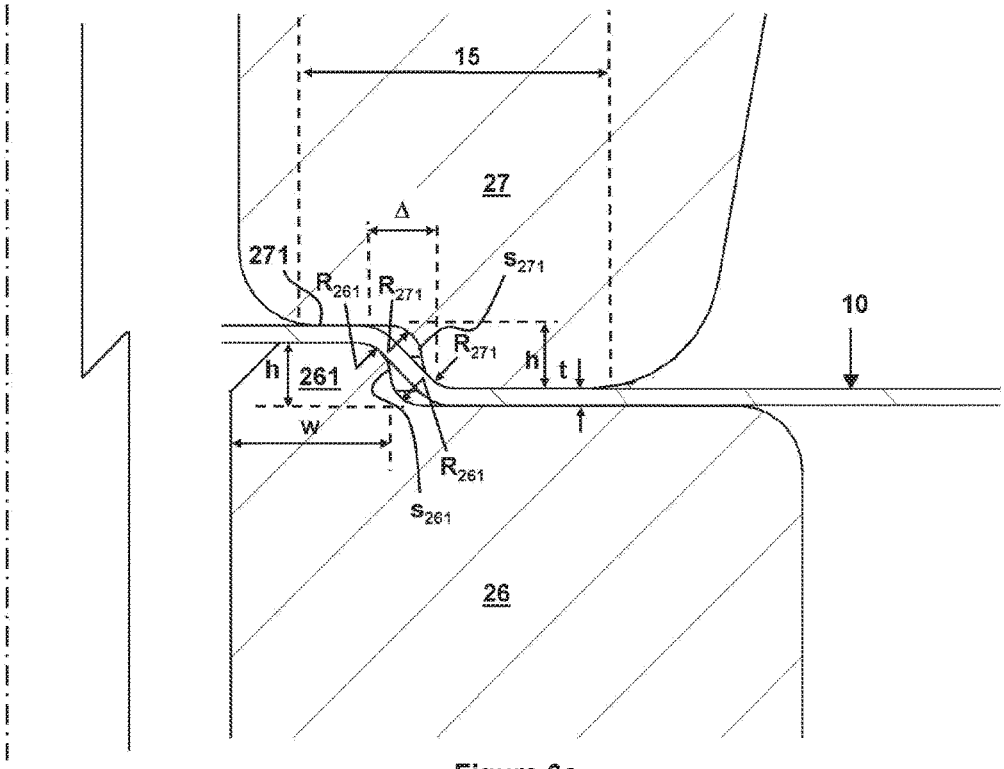

FIG. 6*a* shows a cross-section through a first embodiment of clamping means used to clamp the metal sheet during the stretching operation.

Figure 6B:
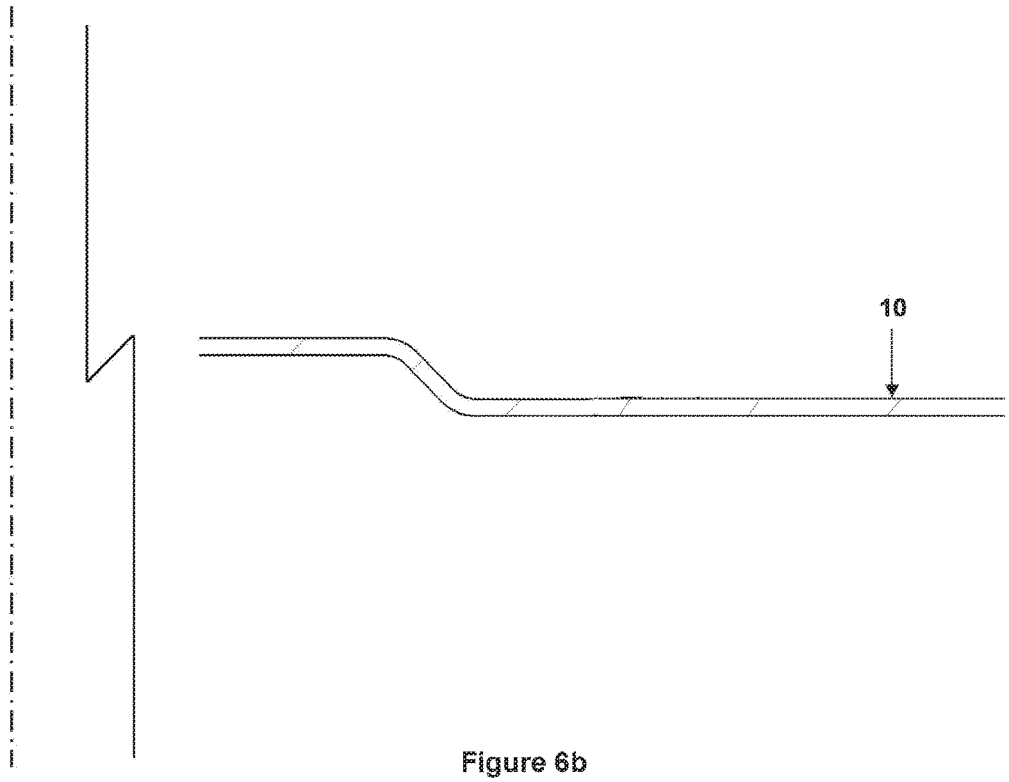

FIG. 6*b* shows a cross-section through part of the metal sheet resulting from use of the clamping means shown in FIG. 6*a*.

Figure 7A:
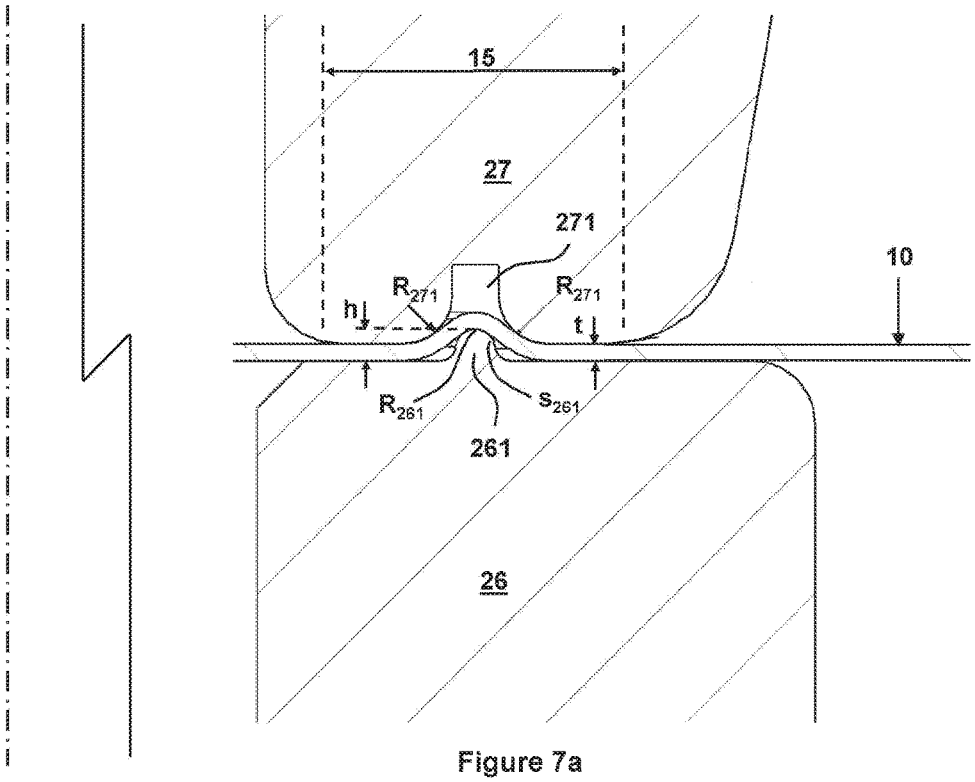

FIG. 7*a* shows a cross-section through a second embodiment of clamping means used to clamp the metal sheet during the stretching operation.

Figure 7B:
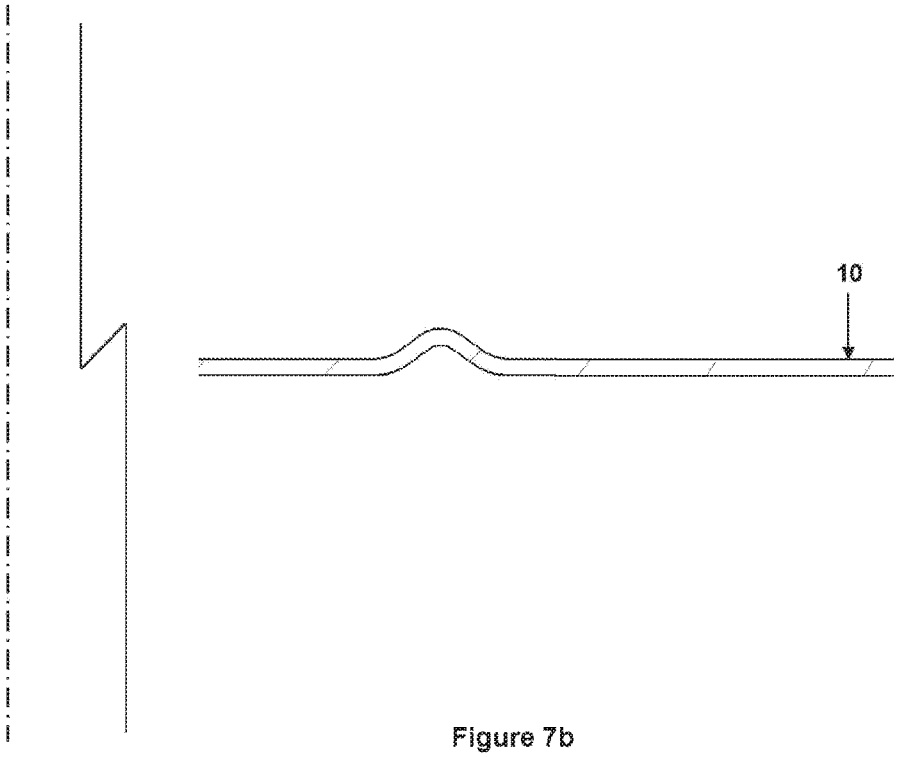

FIG. 7*b* shows a cross-section through part of the metal sheet resulting from use of the clamping means shown in FIG. 7*a*.

Figure 8:
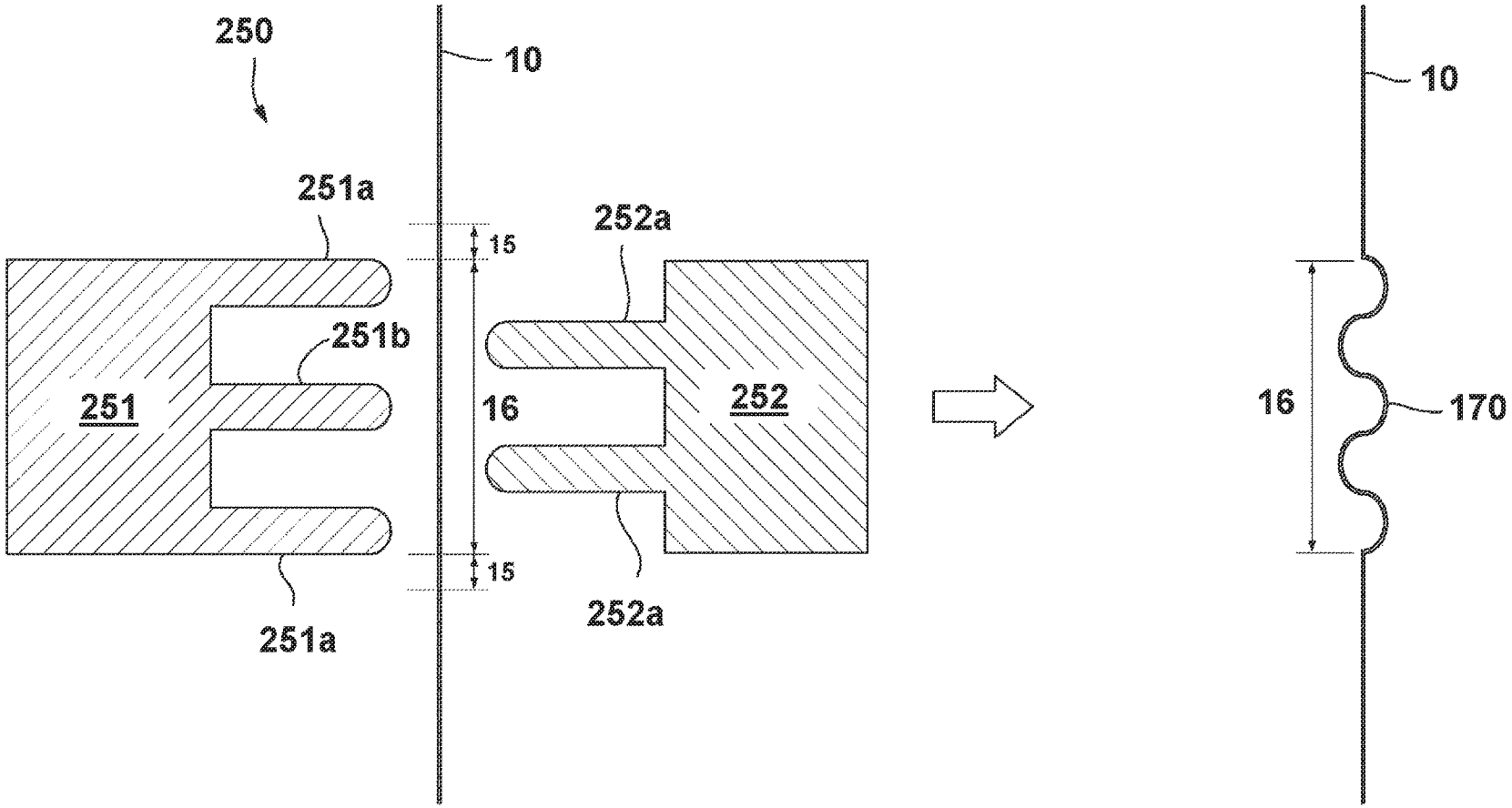

FIG. 8 shows an alternative embodiment of stretch punch to that shown in FIGS. 5*a* and 5*b*.

Figure 9:
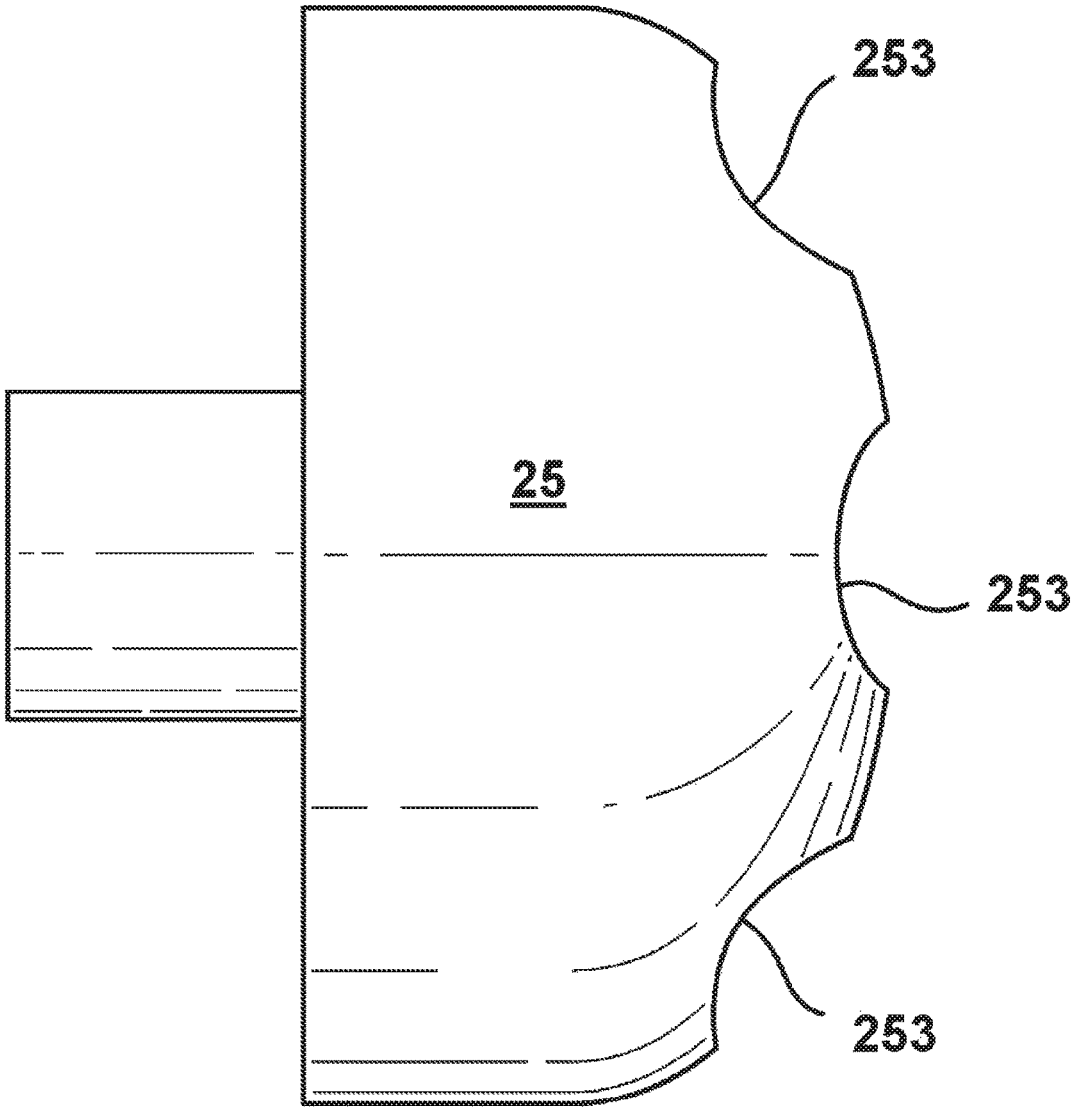

FIG. 9 shows a further alternative embodiment of stretch punch to that shown in FIGS. 5*a* and 5*b*, where the end face of the stretch punch includes various relief features.

Figure 10:
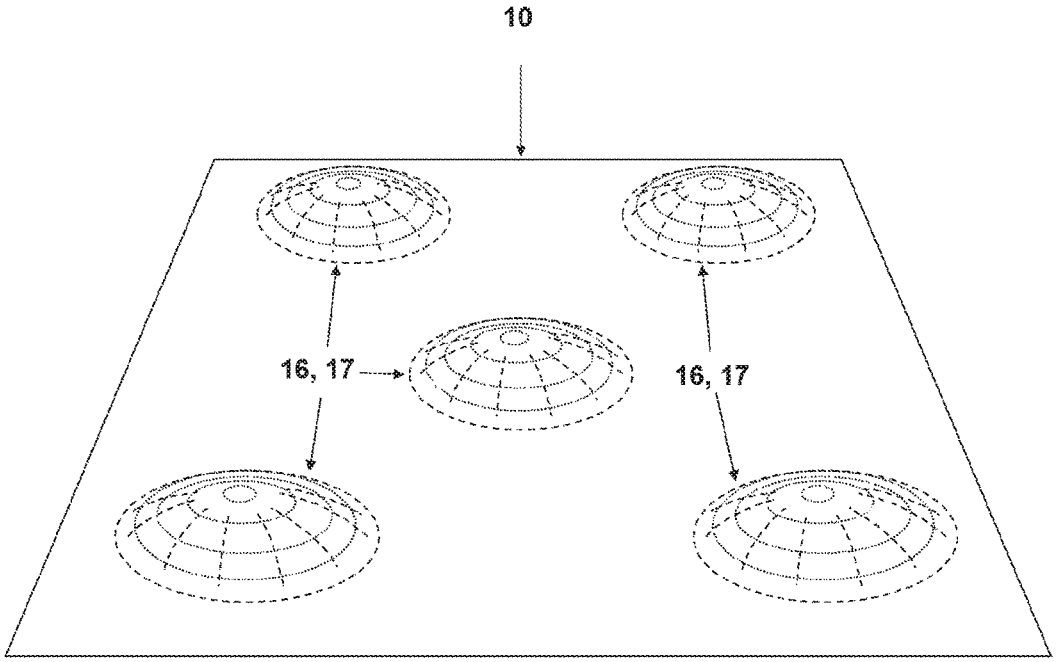

FIG. 10 shows an expanse of metal sheet on which the stretching operation of the invention has been performed on a plurality of "enclosed portions" separated from each other and disposed across the area of the metal sheet.

Figure 11A:
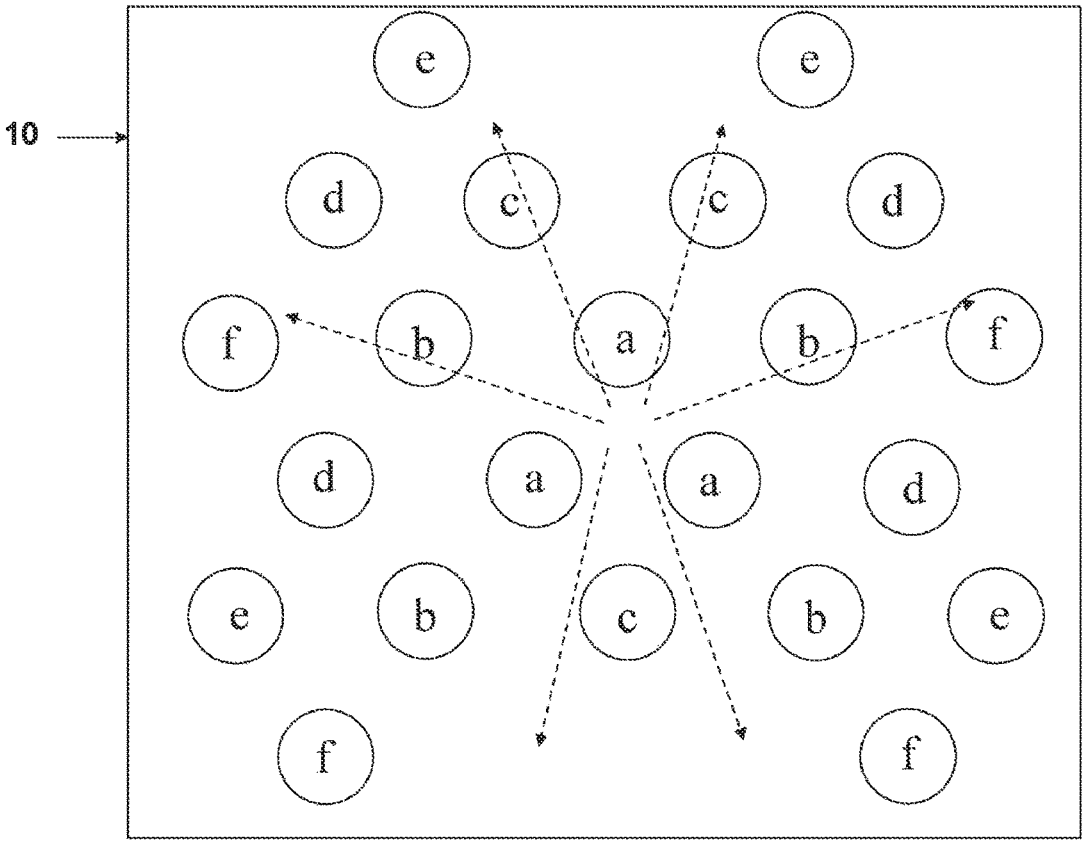
Figure 11B:
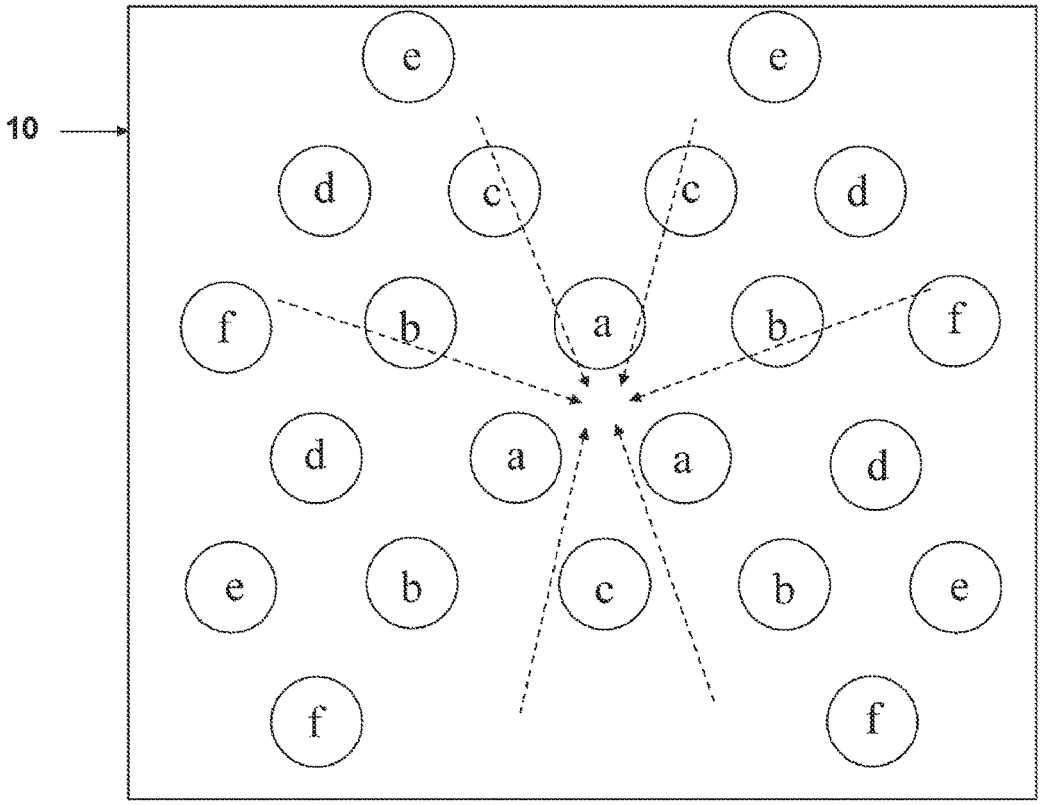

FIGS. 11*a* and 11*b* show how, when performing the stretching operation to provide the stretched sheet shown in FIG. 10, any simultaneous stretching of two or more of the enclosed portions may be staggered to reduce the loads imposed on the tooling used.

Figure 12A:
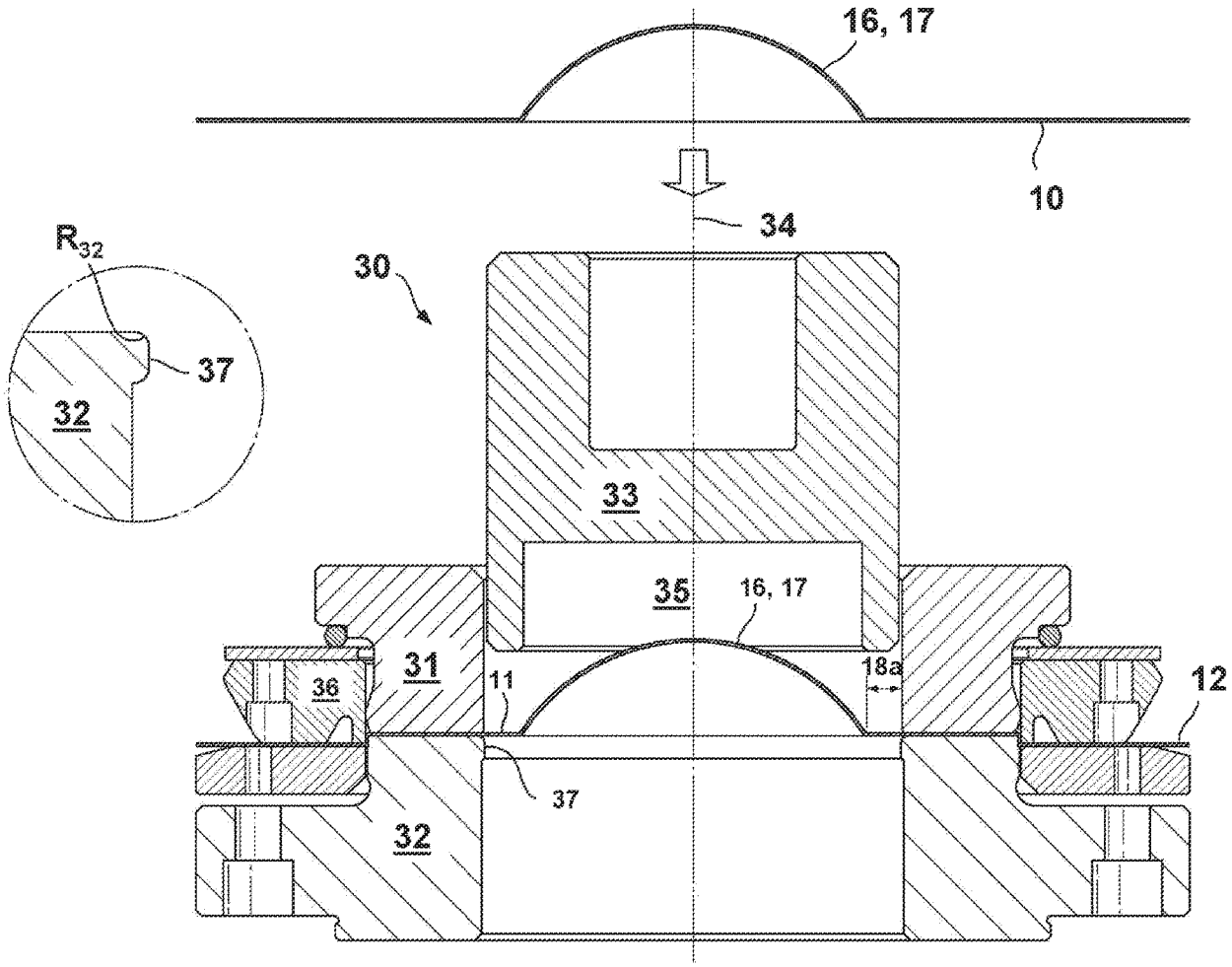

FIG. 12*a* is a side elevation view of the tooling of a cupping press used to perform an initial drawing stage of the drawing operation to form a cup from the stretched sheet metal. The figure shows the tooling before this initial drawing stage has commenced.

Figure 12B:
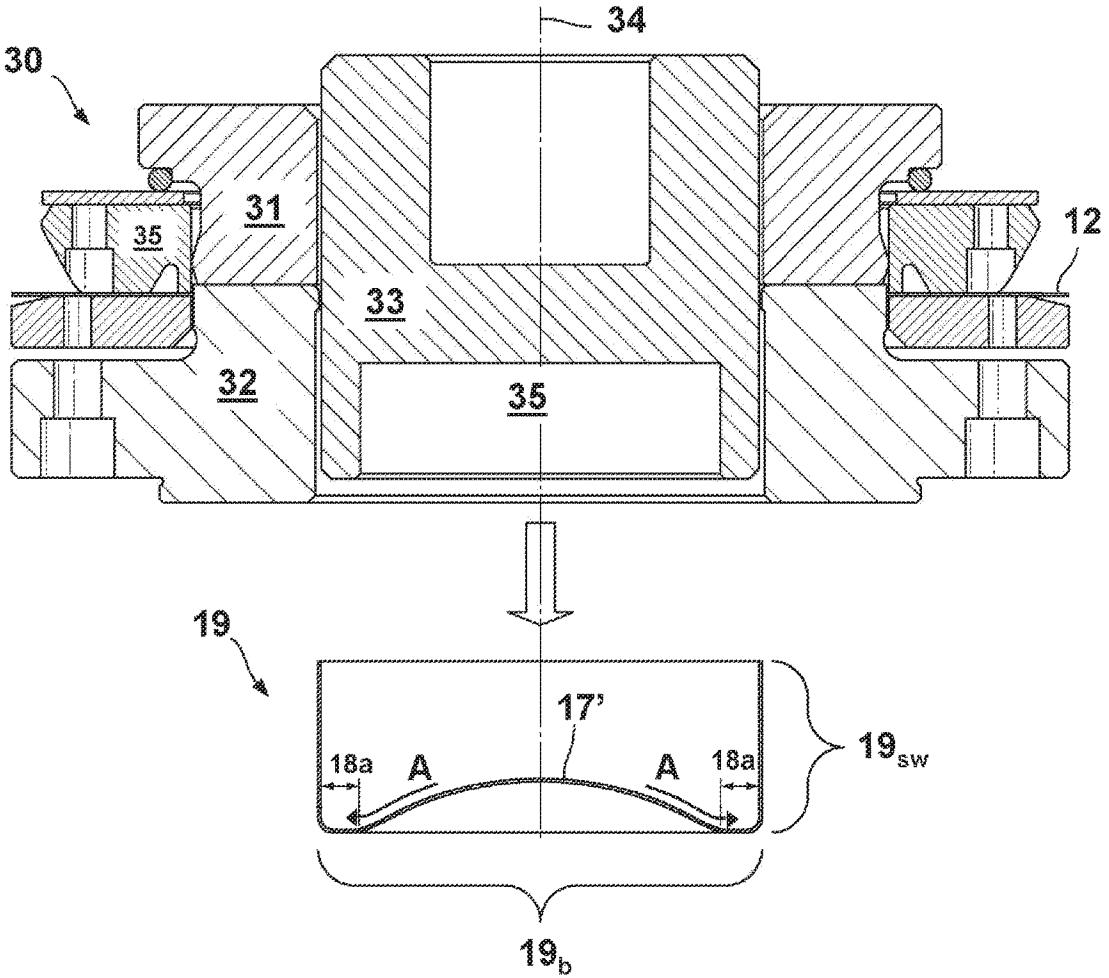

FIG. 12*b* corresponds to FIG. 12*a*, but on completion of the initial drawing stage.

FIGS. 13*a-d* show perspective views of a bodymaker assembly used to re-draw the cup in a re-drawing stage of the drawing operation. The figures show the operation of the bodymaker from start to finish of the redrawing stage.

Figure 13A:
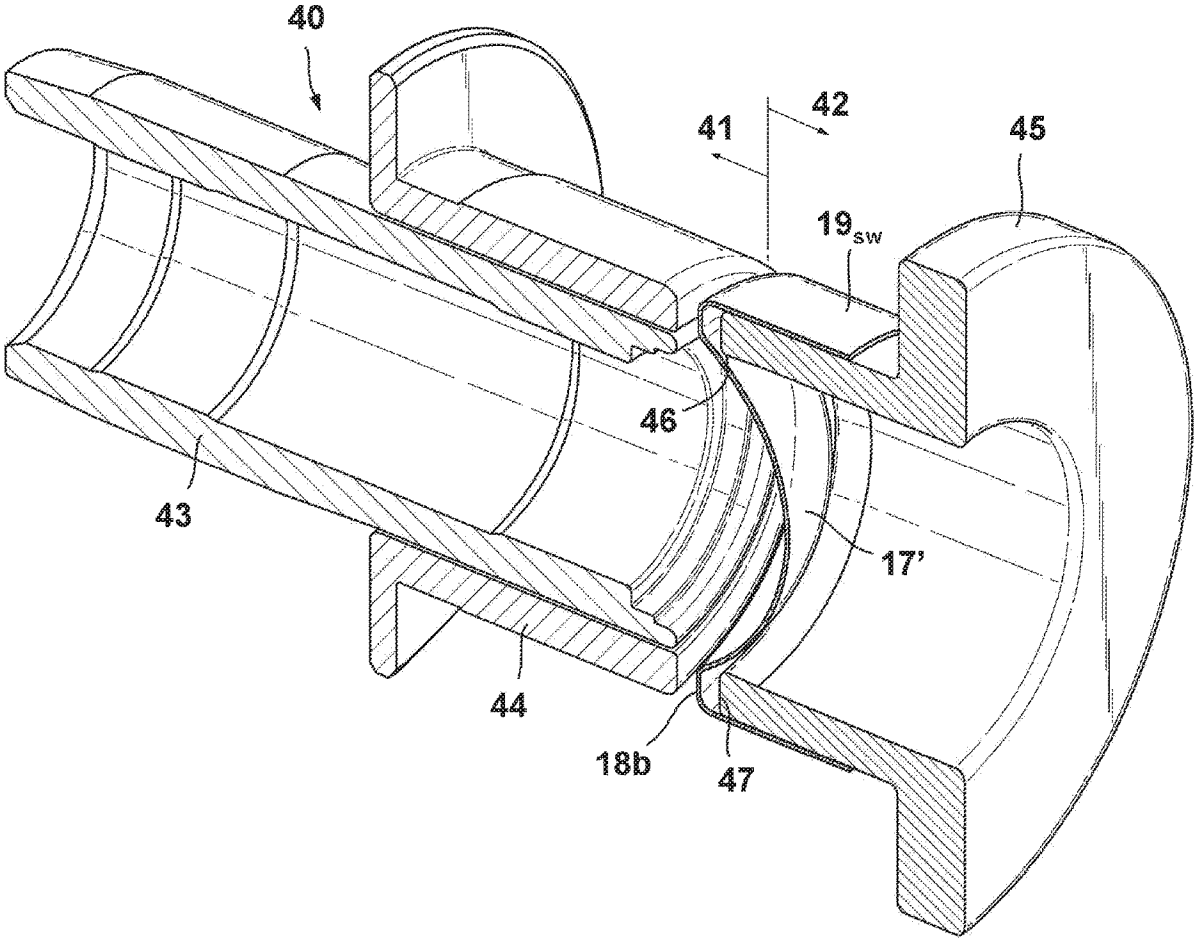
Figure 13B:
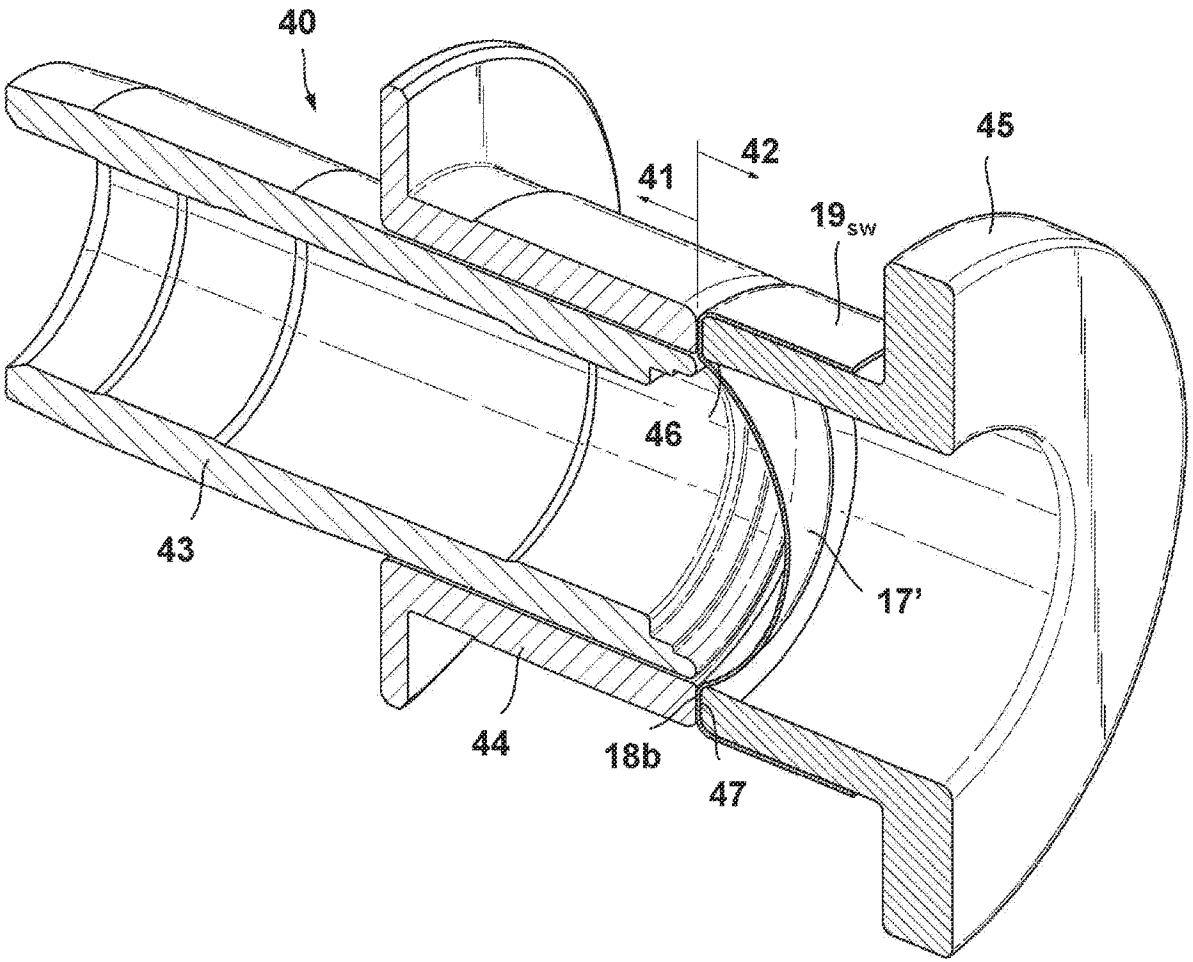
Figure 13C:
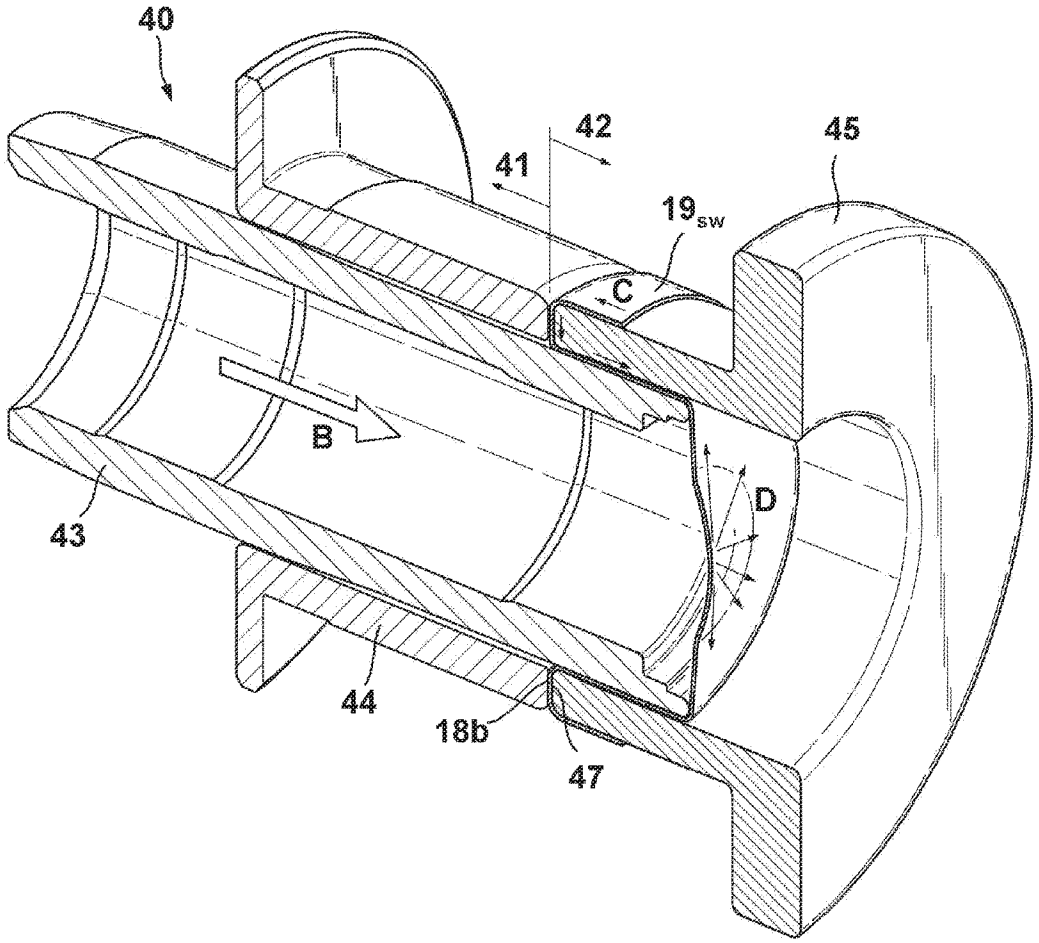
Figure 13D:
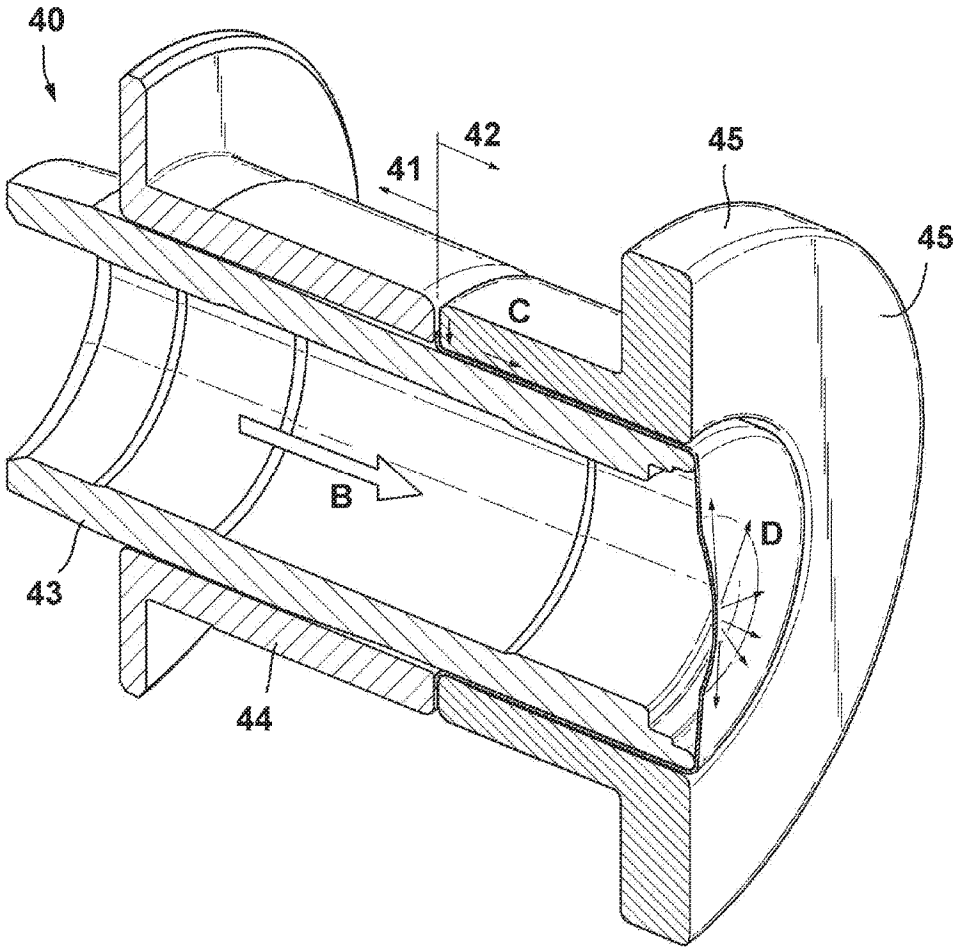
Figure 14:
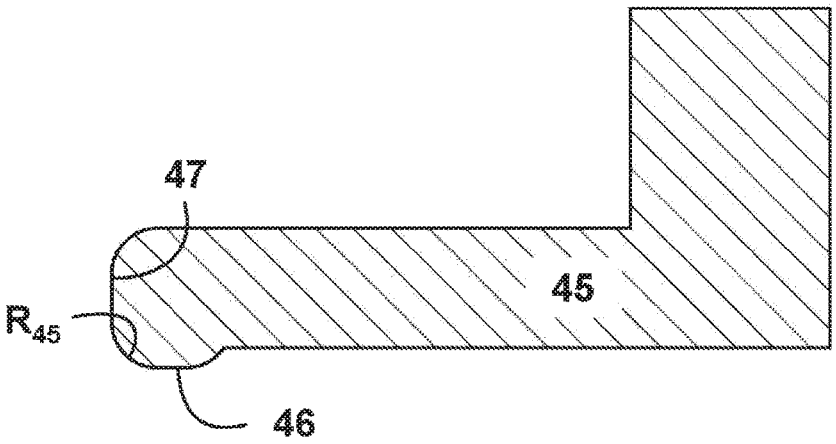

FIG. 14 shows a detail view of the re-draw die used in the bodymaker assembly of FIGS. 13*a-d*.

Figure 15:
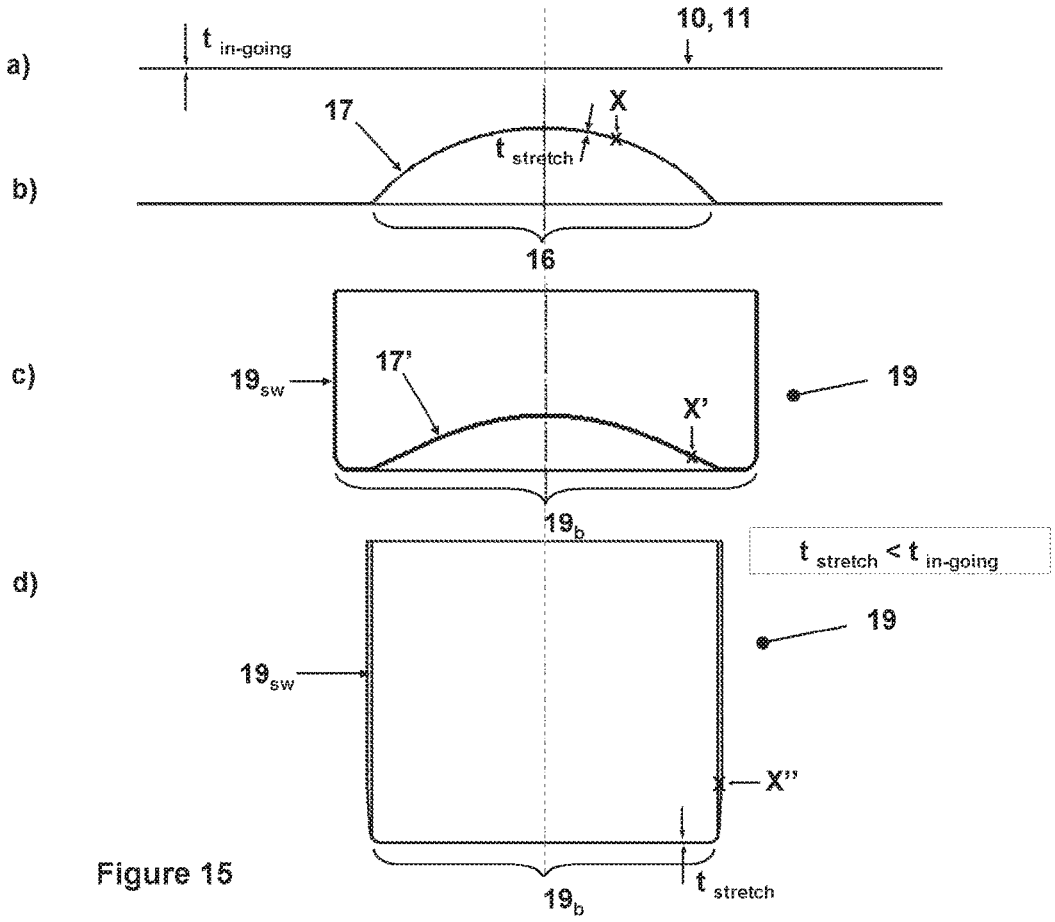

FIG. 15 shows a sheet metal blank at various stages during the method of the invention as it progresses from a planar sheet to a finished cup.

Figure 16:
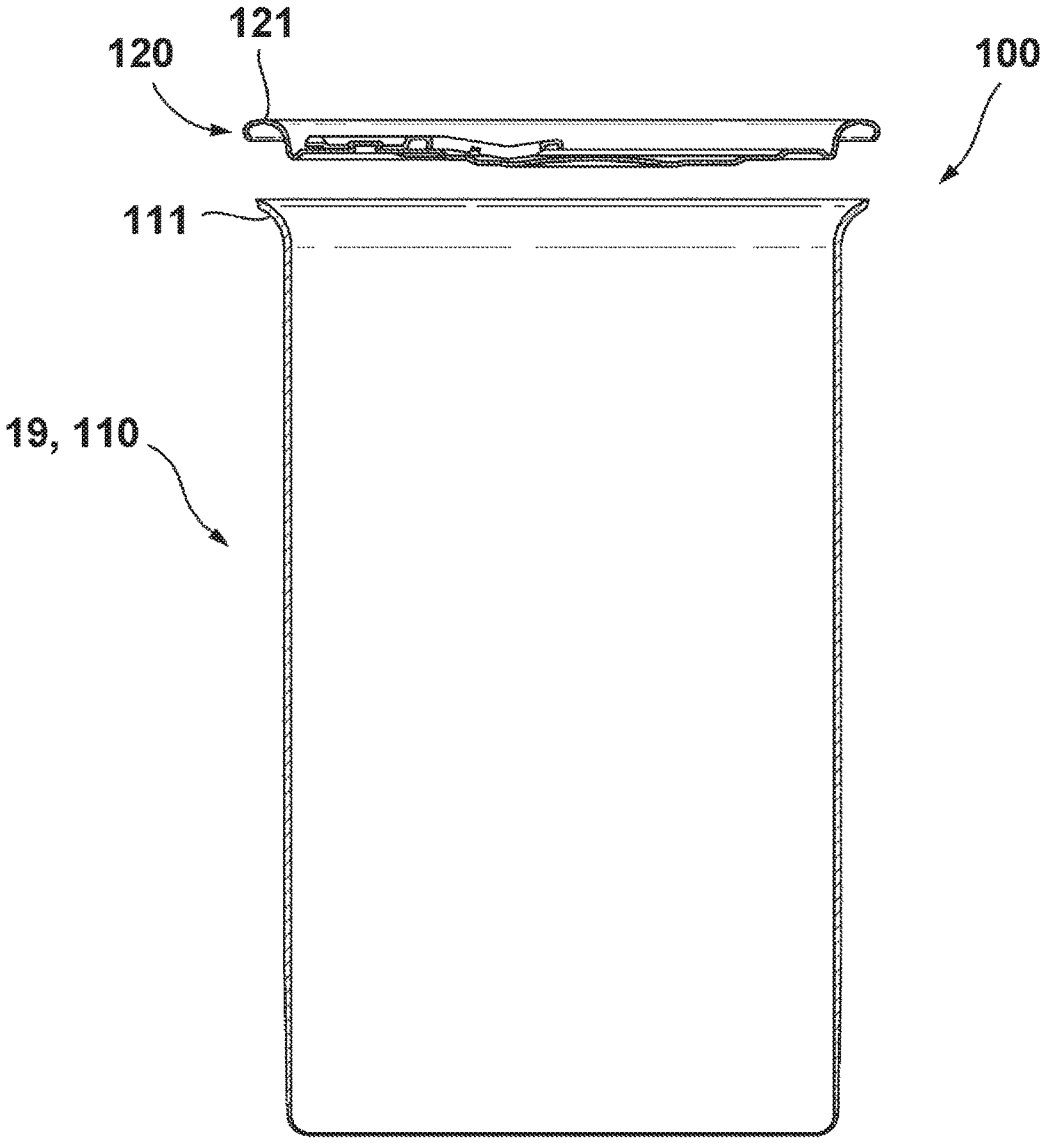

FIG. 16 shows the use of the cup of the invention as part of a two-piece container.

DETAILED DESCRIPTION OF ILLUSTRATIVE EMBODIMENTS

Mode(s) for Carrying Out the Invention

Stretching Operation

A flat section of metal sheet 10 is located within a stretch rig 20 (an example of which is illustrated in FIGS. 5*a* and 5*b*). Steel tin-plate (Temper 4) with an ingoing gauge thickness ($t_{in\text{-}going}$) of 0.280 mm has been used for the metal sheet 10. However, the invention is not limited to particular gauges or metals. The section of metal sheet 10 is typically cut from a roll of metal sheet (not shown). The stretch rig 20 has two platens 21, 22 that are moveable relative to each other along parallel axes 23 under the action of loads applied through cylinders 24 (see FIGS. 5*a* and 5*b*). The loads may be applied by any conventional means, e.g. pneumatically, hydraulically or through high-pressure nitrogen cylinders.

On platen 21 is mounted a stretch punch 25 and a clamping element in the form of a first clamp ring 26. The first clamp ring 26 is located radially outward of the stretch punch 25. The stretch punch 25 is provided with a domed end face (see FIGS. 5*a* and 5*b*).

On platen 22 is mounted a second clamp ring 27. The second clamp ring 27 is a tubular insert having an annular end face 28 (see FIGS. 5*a* and 5*b*). In use, loads are applied via the cylinders 24 to move platens 21, 22 towards each other along the axes 23 until the flat section of metal sheet 10 is clamped firmly in an annular manner between the first and second clamp rings 26, 27 to define a clamped annular region 15 on the section of metal sheet. In this way, the first clamp ring 26 and the second clamp ring 27 each act as clamping elements. The clamped annular region 15 defines an enclosed portion 16 on the metal sheet 10.

The stretch punch 25 is then moved axially through the first clamp ring 26 to progressively deform and stretch (thin) the metal of the enclosed portion 16 into a domed profile 17 (see FIG. 5*b*).

Ideally, the clamping loads applied during this stretching operation are sufficient to ensure that little or no material from the clamped annular region 15 (or from outside of the clamped region) flows into the enclosed portion 16 during stretching. This helps to maximise the amount of stretching and thinning that occurs in the enclosed portion 16. However, as indicated above in the general description of the invention, it has been found that stretching and thinning of the metal of the enclosed portion 16 can still occur when permitting a limited amount of flow of metal from the clamped annular region 15 (or from outside of the clamped region) into the enclosed portion.

FIGS. 6*a* & 7*a* show detail views of two embodiments of the first clamp ring 26 and second clamp ring 27 used to clamp the metal sheet 10 during the stretching operation.

FIG. 6*a* shows the face of the first clamp ring 26 provided with an annular step 261 having a width w that opens out to the radial interior edge of the first clamp ring. A corresponding annular cut-out 271 is provided in the face of the second clamp ring 27. In the embodiment shown, the step 261 and cut-out 271 have a height h of 1 mm and radii $R_{261,\ 271}$ of 0.5 mm. The axially extending sides $S_{261,\ 271}$ of the step 261 and cutout 271 are radially offset from each other by a distance greater than the thickness t of the metal sheet they are intended to clamp (see distance Δ in FIG. 6*a*). This avoids the metal sheet being pinched or coined during clamping and thereby helps to minimize the formation of a weakened region that would be vulnerable to tearing during the subsequent drawing operation (or any subsequent ironing operation).

FIG. 6*b* shows a partial view of the metal sheet that results from use of the clamping arrangement shown in FIG. 6*a*.

FIG. 7*a* shows the face of the first clamp ring 26 provided with an annular bead 261 located away from the radial interior and exterior edges of the first clamp ring. A corresponding annular recess 271 is provided in the face of the second clamp ring 27. In this alternative embodiment, the bead 261 is capable of being wholly enclosed by and within the recess 271—in contrast to the embodiment in FIG. 6*a*. Expressed another way, in use, the bead 261 of FIG. 7*a* urges metal of the clamped annular region 15 so as to be wholly enclosed by and within the recess 271. In this embodiment, the bead 261 has a height h of around 0.5 mm, with radii R261, 271 of around 0.3 mm and 0.75 mm respectively. As can be seen from FIG. 7*a*, in common with the embodiment in FIG. 6*a*, the bead 261 and recess 271 are profiled to avoid the metal sheet being pinched or coined during clamping.

FIG. 7*b* shows a partial view of the metal sheet that results from use of the clamping arrangement shown in FIG. 7*a*.

Both clamping embodiments have been used on 0.277 mm and 0.310 mm gauge metal sheet. However, this statement is not intended to limit the scope or applicability of the method or apparatus of the invention.

Table 1 below shows for both clamping embodiments (FIGS. 6*a* and 7*a*) the axial clamping loads required during the stretching operation to achieve a given amount of stretching. Note that the data in Table 1 was based upon clamping and stretching the planar base of a cup (as shown in FIGS. 7*a*, 7*b*, 8*a* and 8*b* of application PCT/EP11/051666 (CROWN Packaging Technology, Inc); however, the data is equally applicable to the present invention because the region being clamped and stretched is planar in both cases. Table 1 clearly show that having the bead 261 adapted to be wholly enclosed by and within the recess 271 (as in the embodiment of FIG. 7*a*) drastically reduces the clamping loads required by almost 50% relative to the loads required when using the clamping arrangement of FIG. 6*a*. The reason for this difference in required axial clamping loads is that having the bead 261 capable of extending wholly within the corresponding recess 271 provides greater disruption to metal flow during the stretching operation and thereby provides an improved clamping effect. The disruption to metal flow is greater for the embodiment of FIG. 7*a* because the metal flow is disrupted by both axially extending sides $S_{261}$ of the bead 261, whereas for the embodiment of FIG. 6*a* the metal flow is only disrupted by a single axially extending side S261 of its bead.

TABLE 1

| Clamping Embodiment | Axial Clamping Force (kN) | Slippage (mm) |
|---|---|---|
| FIG. 6a | 46-53 | 0.85-1.3 |
| FIG. 7a | 25-29 | 0.05 |

In an alternative embodiment, the single stretch punch 25 is replaced by a punch assembly 250 (as shown in FIG. 8). The punch assembly 250 has:

i) a first group 251 of an annular punch element 251 a surrounding a central core punch element 251*b*; and ii) a second group 252 of an annular punch elements 252*a*.

For ease of understanding, FIG. 8 only shows the punch assembly 250 and the section of metal sheet 10. Although not shown on FIG. 8, in use, an annular region 15 of the metal sheet 10 would be clamped during the stretching operation in a similar annular manner to the embodiment shown in FIGS. 5*a* and 5*b*.

In use, the first and second groups of punch elements 251, 252 face opposing surfaces of the enclosed portion 16 of the metal sheet 10. The stretching operation is performed by moving both first and second groups of punch elements 251, 252 towards each other to deform and stretch (thin) the metal of the enclosed portion 16. The enclosed portion 16 is deformed into an undulating profile 170 (see FIG. 8).

In a further embodiment, a single stretch punch 25 has a number of relief features in the form of recesses/cut-outs 253 provided in its end face (see FIG. 9). In the embodiment shown in FIG. 9, there is a central recess/cut-out surrounded by a single annular recess/cut-out. However, alternative configurations of recess/cut-out may be used.

The embodiment in FIGS. 5*a*, 5*b* is shown punching a single enclosed portion in a section of metal sheet 10. However, the apparatus shown in FIGS. 5*a*, 5*b* can used to stretch and thin a plurality of enclosed portions 16 separated from each other and disposed across the area of the metal sheet 10. FIG. 10 shows the section of metal sheet 10 having undergone such a stretching operation to define a number of stretched and thinned domed enclosed portions 16, 17 disposed across the area of the sheet. Whilst this be done using a single stretch punch performing a number of successive stretching operations across the area of the metal sheet 10, it is preferred that the apparatus includes a plurality of stretch punches which allow simultaneous stretching operations to be performed on a corresponding number of enclosed portions disposed across the area of the metal sheet. However, to reduce the loads imposed on the tooling used for stretching, it is beneficial to stagger any simultaneous stretching operations so that not all of the enclosed portions across the sheet are stretched at the same time. FIGS. 11*a* and 11*b* indicate six groups of enclosed portions—'a', 'b', 'c', 'd', 'e' and 'f'. In use, all the enclosed portions in each group would be stretched simultaneously. In the embodiment shown in FIG. 11*a*, the stretching would progress radially outwardly from group 'a', to group 'b', to group 'c', to group 'd', to group 'e', to group 'f'. In the alternative embodiment shown in FIG. 11*b*, the stretching would progress radially inwardly from group 'f', group 'e', to group 'd', to group 'c', to group 'b', to group 'a'. On completion of the stretching, separate blanks would be cut from the stretched metal sheet for subsequent drawing.

Note that FIGS. 10, 11*a* and 11*b* are illustrative only and are not intended to be to scale.

Initial Drawing Stage of Drawing Operation

On completion of the stretching operation, the metal sheet 10 with its stretched and thinned domed enclosed portion 16, 17 is moved to a cupping press 30. The cupping press 30 has a draw pad 31 and a draw die 32 (see FIGS. 12*a* and 12*b*). A draw punch 33 is co-axial with the draw die 32, as indicated by common axis 34. The draw punch 33 is provided with a recess 35. A circumferential cutting element 36 surrounds the draw pad 31.

In use, the section of metal sheet 10 is held in position between opposing surfaces of the draw pad 31 and the draw die 32. The sheet 10 is located so that the domed enclosed portion 16, 17 is centrally located above the bore of the draw die 32. After the metal sheet 10 has been positioned, the circumferential cutting element 36 is moved downwards to cut a blank 11 out from the metal sheet 10 (see FIG. 12*a*). The excess material is indicated by 12 on FIG. 12*a*.

After the blank 11 has been cut from the sheet 10, the draw punch 33 is moved axially downwards into contact with the blank 11 (see FIG. 12*b*). The draw punch 33 first contacts the blank 11 on an annular region 18*a* located adjacent and radially outward of the domed enclosed portion 16, 17 (see FIG. 12*a*). The recess 35 provided in the draw punch 33 avoids crushing of the domed enclosed portion 16, 17 during drawing. The draw punch 33 continues moving downwardly through the draw die 32 to progressively draw the blank 11 against the forming surface 37 of the die into the profile of a cup 19 having a sidewall $\mathbf{19}_{sw}$ and integral base 19*b*. However, the action of the draw punch 33 against the blank 11 also causes material of the domed enclosed portion 16, 17 to be pulled and transferred outwardly (as indicated by arrows A in FIG. 12*b*). This initial drawing stage results in a reduction in height of the domed region due to its material having been drawn outwardly. Dependent on the depth of the draw, the drawing may be sufficient to pull and transfer some of the stretched and thinned material of the domed enclosed portion 16, 17 into the sidewall $\mathbf{19}_{sw}$ during this initial drawing stage, rather than this stretched and thinned material remaining wholly within the base $\mathbf{19}_b$.

FIG. 12*b* includes a separate view of the drawn cup 19 that results from use of the cupping press 30, with the reduced height domed region in the base indicated by 17'. A detail view is included in FIG. 12*a* of the radius $R_{32}$ at the junction between the end face of the draw die 32 and its forming surface 37. As for conventional drawing operations, the radius $R_{32}$ and the load applied by the draw pad 31 to the periphery of the blank 11 are selected to permit the blank to slide radially inwards between the opposing surfaces of the draw pad 31 and draw die 32 and along forming surface 37 as the draw punch 33 moves progressively downwards to draw the blank into the cup 19. This ensures that the blank 11 is predominantly drawn, rather than stretched (thinned) (or worse, torn about the junction between the end face of the draw die and the forming surface 37). Dependent on the size of radius $R_{32}$ and, to a lesser extent, the severity of the clamping load applied by the draw pad 31, negligible stretching or thinning should occur during this initial drawing stage. However, in alternative embodiments of the invention, it is permissible for the load applied by the draw pad 31 to be sufficient that a combination of drawing and further stretching occurs under the action of the draw punch 33. The cup 19 that results from this initial drawing stage is also referred to the "first stage cup".

In an alternative embodiment of the invention not shown in FIGS. 12*a* and 12*b*, if the depth of draw were sufficient it would result in the domed enclosed portion 16, 17 being pulled essentially flat in this initial drawing stage to define a cup 19 having an essentially flat base $\mathbf{19}_b$.

Re-Drawing Stage of Drawing Operation

The first stage cup 19 resulting from the cupping process shown in FIGS. 12*a* and 12*b* and described above is transferred to a bodymaker assembly 40 (see FIGS. 13*a* to 13*d*). The bodymaker assembly 40 comprises two halves 41, 42 (indicated by arrows in FIGS. 13*a* to 13*d*).

The first half 41 of the bodymaker assembly 40 has a tubular re-draw punch 43 mounted on the same axis as circumferential clamp ring 44. As can be seen from FIGS. 13*a* to 13*d*, the clamp ring 44 circumferentially surrounds the re-draw punch 43 like a sleeve. As will be understood from the following description and looking at FIGS. 13*a* to 13*d*, the re-draw punch 43 is moveable through and independently of the circumferential clamp ring 44.

The second half 42 of the bodymaker assembly 40 has a re-draw die 45. The re-draw die 45 has a tubular portion having an outer diameter corresponding to the internal diameter of the cup 19 (see FIGS. 13*a* to 13*d*). The re-draw die 45 has a forming surface 46 on its inner axial surface which terminates in an annular end face 47 (see FIGS. 13*a* to 13*d*).

In use, the first stage cup 19 is first mounted on the re-draw die 45 (as shown on FIG. 13*a*). Then, as shown in FIG. 13*b*, the two halves 41, 42 of the bodymaker assembly 40 are moved axially relative to each other so that annular region 18*b* of the base of the cup 19 is clamped between the annular end face 47 of the re-draw die 45 and the surface of the circumferential clamp ring 44.

Once clamped, the re-draw punch 43 is then forced axially through the clamp ring 44 and the re-draw die 45 (see arrow B on FIGS. 13*c* and 13*d*) to progressively re-draw the material of the cup 19 along the forming surface 46 of the re-draw die. The use of the re-draw punch 43 and die 45 has two effects:

i) to cause material from the sidewall $\mathbf{19}_{sw}$ to be drawn radially inwards and then axially along the forming surface 46 of the re-draw die 45 (as indicated by arrows C on FIGS. 13*c* and 13*d*). In this way, the cup is reduced in diameter during this re-drawing stage (as indicated by comparing FIG. 13*a* with FIG. 13*d*).

ii) to cause the stretched and thinned material that remains in the reduced height domed region 17' of the base $\mathbf{19}_b$ to be further progressively pulled out and transferred from the base into the reduced diameter sidewall (as indicated by arrows D on FIGS. 13*c* and 13*d*). This has the effect of flattening the base 19*b* (see especially FIG. 13*d*).

FIG. 13*d* shows the final state of the re-drawn cup 19 when the re-draw punch 43 has reached the end of its stroke. It can clearly be seen that the formerly domed region 17' of the base $\mathbf{19}_b$ has now been pulled essentially flat, to provide a cup or container body 19 where the thickness of the base $\mathbf{19}_b$ is thinner than that of the ingoing metal sheet 10. As stated earlier, this reduced thickness in the base $\mathbf{19}_b$—and the consequent weight reduction—is enabled by the stretching operation performed previously.

As shown in the detail view of the re-draw die 45 in FIG. 14, the junction between the forming surface 46 and the annular end face 47 of the re-draw die 45 is provided with a radius R45 in the range 1 to 3.2 mm. The provision of a radius R45 alleviates the otherwise sharp corner that would be present at the junction between the forming surface 46 and the annular end face 47, and thereby reduces the risk of the metal of the cup 19 tearing when being re-drawn around this junction.

The re-drawing stage illustrated in FIGS. 13*a* to 13*d* may also be followed by one or more further re-drawing stages to induce a further reduction in diameter of the cup 19.

Note that although FIGS. 13*a* to 13*d* show use of a tubular re-draw punch 43 having an annular end face, the punch may alternatively have a closed end face. The closed end face may be profiled to press a corresponding profile into the base of the cup.

The drawing operation described above and illustrated in FIGS. 13*a* to 13*d* is known as reverse re-drawing. This is because the re-draw punch 43 is directed to invert the profile of the first stage cup. In effect, the re-draw punch reverses the direction of the material and turns the stretched cup inside out. This can be seen by comparing the cup profiles of FIGS. 13*a* and 13*d*. Reverse re-drawing the cup has the advantages of:

i) preventing uncontrolled buckling of the reduced height domed region 17' of the base (especially when using a re-draw punch having a closed end face); and ii) maximises transfer of material from the domed region 17' to the sidewalls $\mathbf{19}_{sw}$.

Note that although the embodiment shown in FIGS. 13*a* to 13*d* illustrates reverse re-drawing, conventional re-drawing would also work; i.e. where the re-draw punch acts in the opposite direction to reverse re-drawing and does not turn the cup inside out.

FIG. 15 shows the changes undergone by the metal sheet 10 from before any forming operations have been undertaken (view a), to after the stretching operation in the stretch rig 20 (view b), to after the initial drawing stage in the cupping press 30 (view c), and finally to after the re-drawing stage in the bodymaker assembly 40 (view d). The figures clearly show that the base of the final cup ($t_{stretch}$) has a reduced thickness relative to the ingoing gauge of the metal sheet 10 ($t_{in\text{-}going}$), i.e. $t_{stretch}<t_{in\text{-}going}$. As previously stated, this reduced thickness (relative to the ingoing gauge of the metal sheet) is enabled by the stretching process of the invention. The effect of the initial drawing stage in progressively pulling and transferring outward material of the domed enclosed portion 16, 17 is shown on views b and c of FIG. 15, with material at location X pulled and transferred outward to location X' as a result of the initial drawing stage. The effect of the re-drawing stage is shown in view d of FIG. 15, with material at location X' pulled and transferred to location X" in the sidewall $\mathbf{19}_{sw}$.

To maximise the height of the sidewall $\mathbf{19}_{sw}$ of the cup with its thinned base, the cup may also undergo ironing of the sidewalls by being drawn through a succession of ironing dies (not shown) in an ironing operation. This ironing operation has the effect of increasing the height and decreasing the thickness of the sidewall.

FIG. 16 shows a container 100 where the final resulting cup 19 has undergone such an ironing operation to form container body 110. The container body 110 is flared outwardly 111 at its access opening. Can end 120 is provided with a seaming panel 121, the seaming panel enabling the can end to be fastened to the container body by seaming to the flared portion 111.

What is claimed:

1. An apparatus for manufacture of a metal cup for a two-piece food container, the apparatus comprising:

a clamping tool adapted to clamp a metal sheet during a stretching operation, the clamping tool adapted to clamp an annular region on the sheet to define an enclosed portion;

a stretch tool adapted to deform and stretch all or part of the enclosed portion in the stretching operation to thereby increase the surface area and reduce the thickness of the enclosed portion, the clamping tool further adapted to restrict or prevent metal flow from the clamped region into the enclosed portion during the stretching operation; and a drawing tool adapted to draw the metal sheet into the cup having a sidewall and an integral base, the base comprising material from the stretched and thinned enclosed portion, the drawing tool further adapted to pull and transfer outwardly material of the stretched and thinned enclosed portion into the sidewall in a drawing operation, whereby lightweighting of the cup is achievable in a cost-effective manner.

2. The apparatus as claimed in claim 1, wherein the clamping tool comprises a clamping element having a clamping face, the clamping face having a textured surface.

3. The apparatus as claimed in claim 1, wherein the clamping tool comprises a first clamping element and a second clamping element, the first and second clamping elements adapted to clamp opposing surfaces of the metal sheet, each of the first and second clamping elements having a clamping face having geometric discontinuities to thereby assist in disrupting the flow of the metal of the metal sheet between the first and second clamping elements as the stretching operation is performed.

4. The apparatus as claimed in claim 3, wherein the geometric discontinuities comprise any one of:

i. the clamping face of the first clamping element having one or more beads, ridges or steps which, in use, urge metal of the clamped annular region within corresponding one or more relief features in the clamping face of the second clamping element; or ii. the clamping face of the second clamping element instead having one or more beads, ridges or steps which, in use, urge metal of the clamped annular region within corresponding one or more relief features instead in the clamping face of the first clamping element; or iii. a combination of (i) and (ii).

5. The apparatus as claimed in claim 4, wherein the first and second clamping elements are adapted such that, in use, the one or more beads, ridges or steps in the clamping face of the first or second clamping element urge metal of the clamped annular region so as to be wholly enclosed by and within the corresponding one or more relief features in the corresponding clamping face of the second or first clamping element.

6. The apparatus as claimed in claim 1, wherein the stretch tool comprises a stretch punch, the apparatus adapted to move either or both of the stretch punch and the metal sheet toward each other so that, in use, the stretch punch deforms and stretches all or part of the enclosed portion.

7. The apparatus as claimed in claim 6, wherein the stretch punch has an end face with a non-planar profile, the apparatus adapted to move either or both of the stretch punch and the metal sheet toward each other so that, in use, the stretch punch deforms and stretches all or part of the enclosed portion into a corresponding non-planar profile.

8. The apparatus as claimed in claim 6, wherein the stretch punch comprises an end face having one or more relief features.

9. The apparatus as claimed in claim 6, wherein the stretch punch comprises a punch assembly, the assembly comprising a first group of one or more punches opposing one surface of the enclosed portion and a second group of one or more punches opposing the opposite surface of the enclosed portion, the first and second groups moveable towards each other to, in use, deform and stretch all or part of the enclosed portion.

10. The apparatus as claimed in claim 1, wherein the drawing tool is adapted to first initially draw the sheet into a cup profile and to then subsequently re-draw the cup in one or more stages.

11. The apparatus as claimed in claim 1, further comprising a tool for ironing the cup.

12. An apparatus as claimed in claim 1, wherein the drawing tooling is adapted to reduce a height of a dome formed by the stretch tool by pulling and transferring material of the stretched and thinned base.

* * * * *